US012618322B2

(12) United States Patent
Alshaikh et al.

(10) Patent No.: US 12,618,322 B2
(45) Date of Patent: May 5, 2026

(54) DISPENSING MICROPROCESSOR DEVICES FOR DOWNHOLE DATA COLLECTION

(71) Applicant: Saudi Arabian Oil Company, Dhahran (SA)

(72) Inventors: Abrar Alshaikh, Saihat (SA); Raed Alahmdi, Thuwal (SA); Bodong Li, Shanghai (CN)

(73) Assignee: Saudi Arabian Oil Company, Dhahran (SA)

( * ) Notice: Subject to any disclaimer, the term of this patent is extended or adjusted under 35 U.S.C. 154(b) by 100 days.

(21) Appl. No.: 18/617,359

(22) Filed: Mar. 26, 2024

(65) Prior Publication Data

US 2025/0305413 A1 Oct. 2, 2025

(51) Int. Cl.
*E21B 47/12* (2012.01)

(52) U.S. Cl.
CPC ..... *E21B 47/138* (2020.05)

(58) Field of Classification Search
CPC ..... E21B 47/138
See application file for complete search history.

(56) References Cited

U.S. PATENT DOCUMENTS 6,241,028 B1 * 6/2001 Bijleveld ..... E21B 47/00 175/40
6,324,904 B1 12/2001 Ishikawa et al.
6,443,228 B1 9/2002 Aronstam et al.
7,766,084 B2 8/2010 Churchill
9,250,339 B2 2/2016 Ramirez et al.
9,739,141 B2 8/2017 Zeng et al.
10,320,311 B2 6/2019 Gooneratne et al.
10,394,193 B2 8/2019 Li et al.
10,428,606 B2 10/2019 Al-Badran et al.
10,472,908 B2 11/2019 Radford et al.
10,999,946 B2 5/2021 Li et al.
11,008,816 B2 5/2021 Zhan et al.
11,085,257 B2 8/2021 Henry et al.
11,111,732 B2 9/2021 Zhan et al.
11,125,046 B2 9/2021 Li et al.
11,125,075 B1 9/2021 Li et al.
11,230,918 B2 1/2022 Gooneratne et al.
11,261,678 B2 3/2022 Li et al.
(Continued)

OTHER PUBLICATIONS

International Search Report and Written Opinion in International Appln. No. PCT/US2025/021294, mailed on Jun. 2, 2025, 13 pages.

*Primary Examiner* — Shane Bomar
(74) *Attorney, Agent, or Firm* — Fish & Richardson P.C.

(57) ABSTRACT

A drilling fluid system includes: at least one microprocessor device; a container that defines an interior volume; a container inlet that provides access for entry of the at least one microprocessor device into the interior volume of the container; a container outlet that provides egress for passage of the at least one microprocessor device from the interior volume of the container into a drilling fluid conduit of the drilling system; and a dispenser apparatus configured to controllably release the at least one microprocessor device through the container outlet into the drilling fluid conduit of the drilling system. The at least one microprocessor device includes a power source and one or more sensors configured to generate sensor data indicating downhole conditions of a well and to wirelessly transmit the sensor data to a computer at a terranean surface.

52 Claims, 15 Drawing Sheets

(56) References Cited

U.S. PATENT DOCUMENTS

| | | | | |
|---|---|---|---|---|
| 11,280,178 | B2 | 3/2022 | Li et al. | |
| 11,286,733 | B2 | 3/2022 | Li et al. | |
| 11,414,963 | B2 | 8/2022 | Li et al. | |
| 11,414,980 | B1 * | 8/2022 | Li | E21B 47/013 |
| 11,414,984 | B2 | 8/2022 | Gooneratne et al. | |
| 11,414,985 | B2 | 8/2022 | Gooneratne et al. | |
| 11,434,707 | B2 | 9/2022 | Li et al. | |
| 11,434,708 | B2 | 9/2022 | Li et al. | |
| 11,454,071 | B2 | 9/2022 | Li et al. | |
| 11,459,838 | B2 | 10/2022 | Li et al. | |
| 11,536,113 | B1 | 12/2022 | Alshaikh et al. | |
| 11,572,752 | B2 | 2/2023 | Moellendick et al. | |
| 11,643,878 | B2 | 5/2023 | Li et al. | |
| 11,668,143 | B2 | 6/2023 | Li et al. | |
| 11,724,340 | B2 | 8/2023 | Zhan et al. | |
| 11,846,151 | B2 | 12/2023 | Zhan et al. | |
| 12,024,470 | B2 | 7/2024 | Zhan et al. | |
| 12,042,868 | B2 | 7/2024 | Zhan et al. | |
| 2004/0020643 | A1 * | 2/2004 | Thomeer | E21B 47/01 166/250.11 |
| 2004/0204856 | A1 * | 10/2004 | Jenkins | E21B 47/138 702/6 |
| 2005/0011645 | A1 | 1/2005 | Aronstam et al. | |
| 2009/0151939 | A1 * | 6/2009 | Bailey | E21B 47/12 166/66 |
| 2011/0191028 | A1 | 8/2011 | Ross et al. | |
| 2011/0192592 | A1 * | 8/2011 | Roddy | E21B 47/10 166/250.01 |
| 2012/0132418 | A1 | 5/2012 | McClung, III | |
| 2013/0118733 | A1 * | 5/2013 | Kumar | E21B 47/26 166/254.2 |
| 2013/0175024 | A1 | 7/2013 | Verret et al. | |
| 2017/0067312 | A1 | 3/2017 | Frazier et al. | |
| 2017/0350241 | A1 | 12/2017 | Shi et al. | |
| 2019/0101872 | A1 * | 4/2019 | Li | E21B 47/138 |
| 2020/0165905 | A1 * | 5/2020 | Gooneratne | E21B 49/00 |
| 2020/0367378 | A1 * | 11/2020 | Li | H05K 1/117 |
| 2021/0189863 | A1 | 6/2021 | Gooneratne et al. | |
| 2022/0213375 | A1 | 7/2022 | Al-Umairin et al. | |
| 2023/0184090 | A1 | 6/2023 | Alshaikh et al. | |
| 2023/0184091 | A1 | 6/2023 | Alshaikh et al. | |
| 2023/0184092 | A1 | 6/2023 | Alshaikh et al. | |
| 2023/0184103 | A1 | 6/2023 | Li et al. | |
| 2023/0201921 | A1 | 6/2023 | Zhan et al. | |
| 2025/0003335 | A1 * | 1/2025 | Alabdulkarim | E21B 47/138 |

* cited by examiner

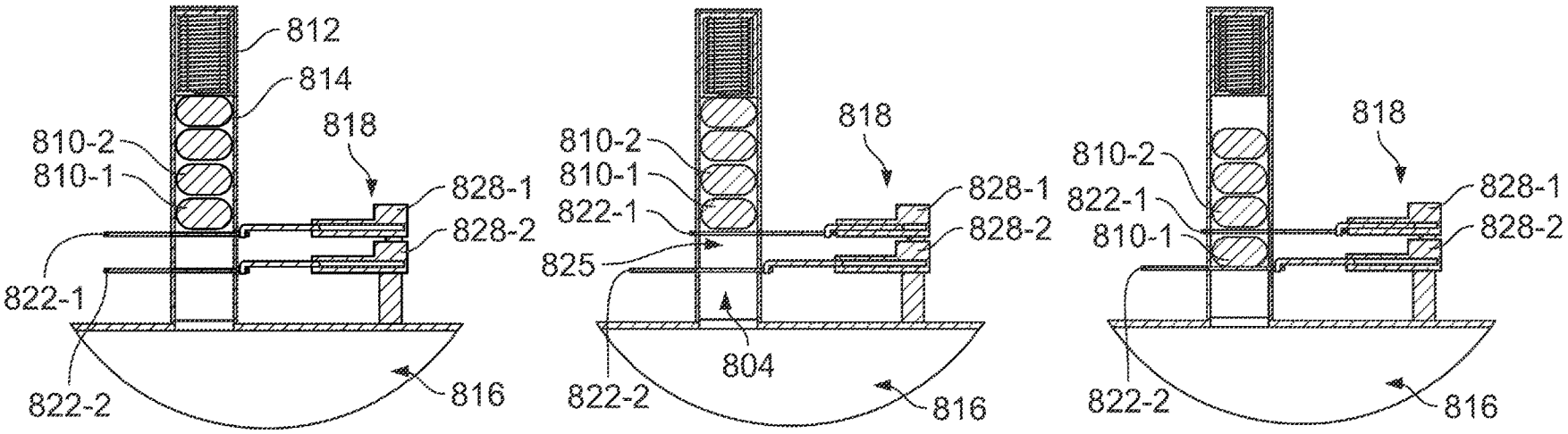
FIG. 9A
FIG. 9B
FIG. 9C
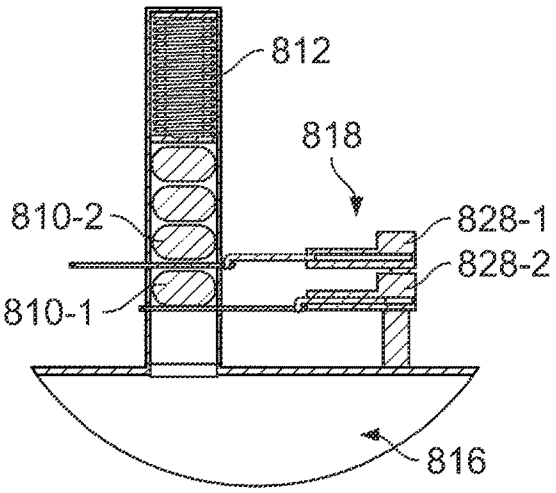
FIG. 9D
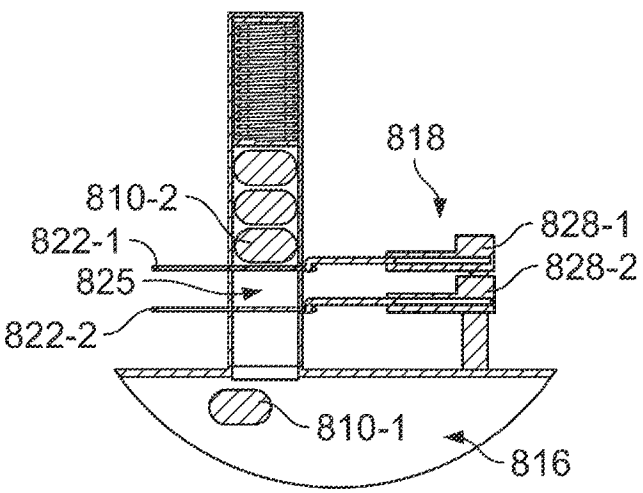
FIG. 9E

DISPENSING MICROPROCESSOR DEVICES FOR DOWNHOLE DATA COLLECTION

TECHNICAL FIELD

The present disclosure relates to dispensing microprocessor devices for data collection in oil and gas applications.

BACKGROUND

Microprocessor devices, or microchips, can be deployed to a wellbore during a drilling operation in order to collect data from the wellbore. Microchips can be dropped manually from the top of a drillpipe (at surface) to be carried by the flow of the drilling fluid to reach the bottom of the drill string at the bottom-hole assembly (BHA). The microchips continue flowing through the drilling bit nozzles to the open-hole annulus, and then travel up with the drilling fluid flow to the cased-hole annulus, and finally, to surface where they can be recovered for data download. Manual deployment of microchips involves manual tracking of the quantity, status, and time of the microchips dropped in each batch. Additionally, manual deployment of microchips includes unmaking pipe connections and remaking pipe connections each time microchips are to be inserted into a pipe.

SUMMARY

The present disclosure describes methods, devices, systems and techniques for dispensing microprocessor devices, or microchips, for downhole data collection. The technology relates to techniques for automated charging, initiation, and controlled release of microchips. In an example implementation, a drilling fluid system includes at least one microprocessor device; a container that defines an interior volume; a container inlet that provides access for entry of the at least one microprocessor device into the interior volume of the container; a container outlet that provides egress for passage of the at least one microprocessor device from the interior volume of the container into a drilling fluid conduit of the drilling system; and a dispenser apparatus configured to controllably release the at least one microprocessor device through the container outlet into the drilling fluid conduit of the drilling system.

In an aspect combinable with the example implementation, the at least one microprocessor device includes a power source and one or more sensors configured to generate sensor data indicating downhole conditions of a well.

In another aspect combinable with one, some, or all of the previous aspects, the at least one microprocessor device is configured to wirelessly transmit the sensor data to a computer at a terranean surface.

Another aspect combinable with one, some, or all of the previous aspects includes an initiation circuit configured to initiate the microprocessor device when the microprocessor device is within the interior volume of the container, wherein initiation of the at least one microprocessor device causes the one or more sensors to begin generating the sensor data.

Another aspect combinable with one, some, or all of the previous aspects includes a charging circuit configured to electrically charge the power source when the at least one microprocessor device is within the interior volume of the container.

In another aspect combinable with one, some, or all of the previous aspects, the container inlet has a higher elevation than the container outlet, and movement of the at least one microprocessor device through the interior volume from the container inlet to the container outlet is assisted by gravity.

Another aspect combinable with one, some, or all of the previous aspects includes a loading device configured to exert a force on the at least one microprocessor device at the container inlet, and movement of the at least one microprocessor device through the interior volume from the container inlet to the container outlet is assisted by the exerted force.

In another aspect combinable with one, some, or all of the previous aspects, the drilling fluid conduit is a drilling fluid pipe, and the at least one microprocessor device pass through the container outlet to a portion of the drilling fluid conduit that is positioned at or above a terranean surface.

In another aspect combinable with one, some, or all of the previous aspects, the container outlet has a higher elevation than the portion of the drilling fluid conduit, and movement of the at least one microprocessor device through the container outlet to the drilling fluid conduit is assisted by gravity.

In another aspect combinable with one, some, or all of the previous aspects, the dispenser apparatus includes a piston operable to exert a force on a microprocessor device of the at least one microprocessor device at the container outlet, and movement of the at least one microprocessor device through the container outlet is assisted by the exerted force.

In another aspect combinable with one, some, or all of the previous aspects, the dispenser apparatus includes a valve including a plate defining an aperture; and a motor coupled to the valve and operable to move the valve relative to the container outlet to align the plate or the aperture with the container outlet.

In another aspect combinable with one, some, or all of the previous aspects, the plate aligning with the container outlet prevents egress of the at least one microprocessor device from the interior volume; and the aperture aligning with the container outlet permits egress of the at least one microprocessor device from the interior volume through the container outlet.

Another aspect combinable with one, some, or all of the previous aspects includes a control system communicably coupled to the dispenser apparatus.

In another aspect combinable with one, some, or all of the previous aspects, the control system is configured to operate the dispenser apparatus to automatically insert the at least one microprocessor device into the drilling fluid conduit at a controlled rate of insertion.

In another aspect combinable with one, some, or all of the previous aspects, the at least one microprocessor device includes a microchip including a casing enclosing an interior region of the microchip, wherein the casing has a substantially spherical exterior shape, a diameter of the casing being fifteen millimeters or less; and a printed circuit board disposed within the interior region of the microchip.

In another example implementation, a method includes feeding the at least one microprocessor device at a container inlet of a container that defines an interior volume, where the container inlet provides access for entry of the at least one microprocessor device into the interior volume of the container; and controllably releasing the at least one microprocessor device through a container outlet. The container outlet provides egress for passage of the at least one microprocessor device from the interior volume of the container into a drilling fluid conduit of a drilling system.

In an aspect combinable with the example implementation, the at least one microprocessor device includes a power source and one or more sensors and is configured to generate sensor data indicating downhole conditions of the drilling system.

Another aspect combinable with one, some, or all of the previous aspects includes initiating the at least one microprocessor device with an initiation circuit when the at least one microprocessor device is within the interior volume of the container.

In another aspect combinable with one, some, or all of the previous aspects, initiation of the at least one microprocessor device causes the at least one microprocessor device to begin generating the sensor data.

Another aspect combinable with one, some, or all of the previous aspects includes electrically charging the power source with a charging circuit when the at least one microprocessor device is within the interior volume of the container.

Another aspect combinable with one, some, or all of the previous aspects includes exerting, by a loading device, a force on the at least one microprocessor devices at the container inlet to cause the at least one microprocessor device to pass through the interior volume from the container inlet to the container outlet.

In another aspect combinable with one, some, or all of the previous aspects, controllably releasing the at least one microprocessor device through the container outlet includes moving a valve including a plate and an aperture relative to the container outlet.

Another aspect combinable with one, some, or all of the previous aspects includes moving the valve to align the plate with the container outlet to prevent microprocessor device egress from the interior volume; and moving the aperture to align the plate with the container outlet to permit microprocessor device egress from the interior volume through the container outlet.

In another aspect combinable with one, some, or all of the previous aspects, controllably releasing the at least one microprocessor device through the container outlet includes controlling a rate of inserting the at least one microprocessor devices into the drilling fluid conduit.

In another aspect combinable with one, some, or all of the previous aspects, the drilling fluid conduit is a pipe; the at least one microprocessor device passes through the container outlet to a portion of the pipe that is positioned at or above a terranean surface; a pressure of the interior volume is lower than a pressure of the portion of the drilling fluid conduit.

In another aspect combinable with one, some, or all of the previous aspects, controllably releasing the at least one microprocessor device through the container outlet includes exerting a force from a piston onto a microprocessor device to move the microprocessor device through the container outlet from the lower pressure of the interior volume to the higher pressure of the portion of the drilling fluid conduit.

Implementations of the present disclosure can provide one or more of the following technical advantages. For example, the techniques described herein can improve accuracy in tracking microchips deployed into a drilling fluid system. For example, each microchip can be electronically scanned and/or tagged prior to deployment, and a timestamp can be collected when the tagged microchip is deployed. The disclosed implementations can also increase useful battery life by reducing an amount of time between initiation and deployment of a microchip. For example, an electrical circuit can charge and initiate a microchip immediately prior to inserting the microchip into a drilling fluid pipe. Thus, when the microchip is inserted, the microchip can have a fully charged, or nearly fully charged, power source. The disclosed implementations can improve safety and operational efficiency. For example, a dispenser apparatus can be connected to a drilling fluid pipe so that the microchips are inserted directly into the drilling fluid pipe. The microchips can thus be inserted while drilling fluid is flowing through the pipe, without isolating the pipe and/or disconnecting and reconnecting pipe fittings.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

FIGS. 9A to 9E illustrate example steps of a release sequence for dispensing microchips sequentially.

It is to be understood that the various exemplary implementations shown in the figures are merely illustrative representations and are not necessarily drawn to scale.

DETAILED DESCRIPTION

Figure 1:
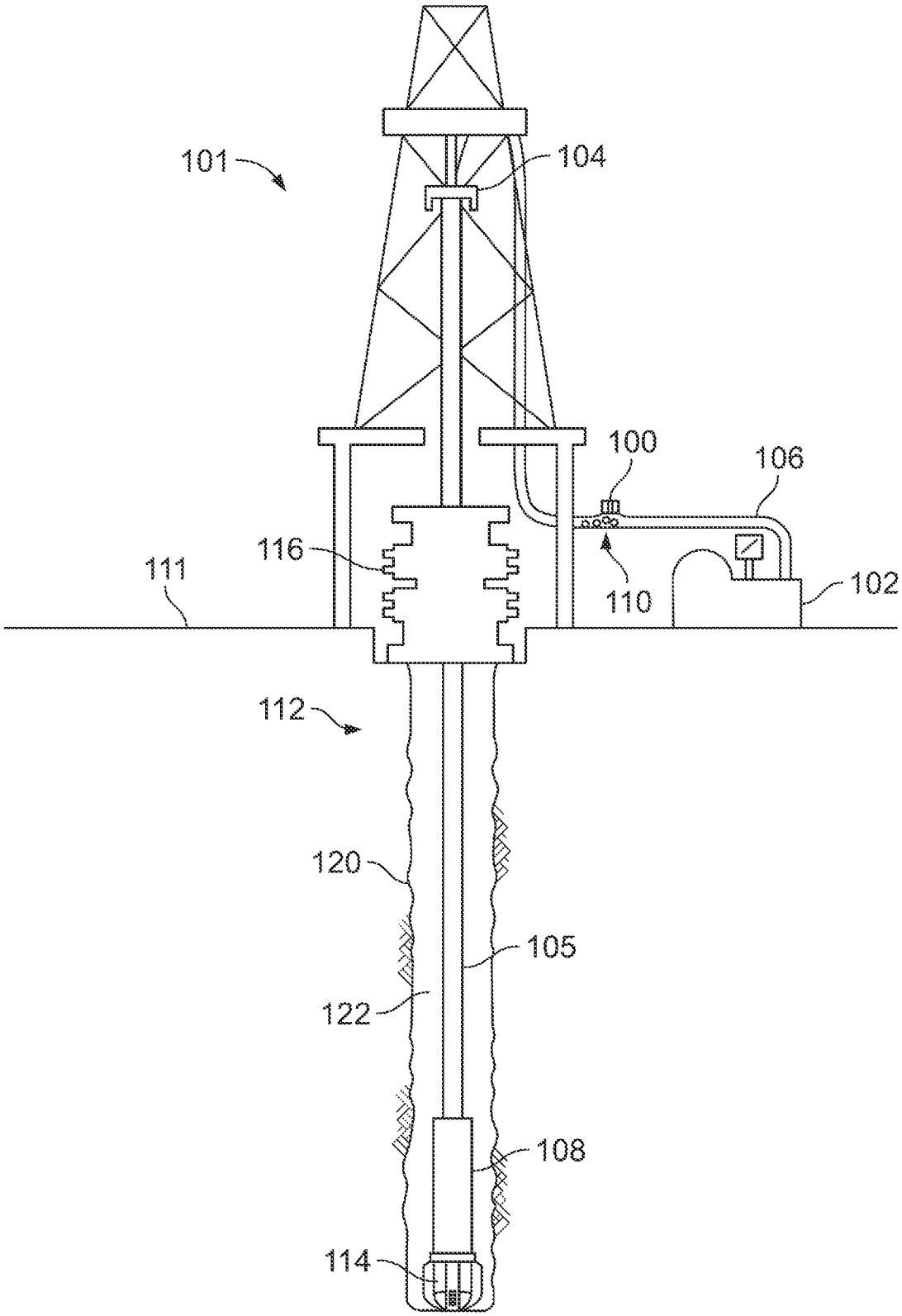
FIG. 1 illustrates an example wellbore system including a dispenser apparatus for microchips.

FIG. 1 illustrates an example wellbore system 101 that includes a dispenser apparatus 100 for microchips. The wellbore 120 is formed into a naturally subterranean formation (or reservoir) containing of one or more hydrocarbon fluids. The subterranean formation that holds the hydrocarbon fluid(s) can be present beneath several other formation rock layers.

A drilling assembly 112 can be used to form the wellbore 120 extending from a terranean surface 111 and through one or more geological formations in the Earth to reach subterranean formations located under the terranean surface 111.

The drilling assembly 112 can include a drilling fluid pump 102, a drilling fluid conduit, or pipe 106, a top drive 104, a blowout preventer 116, a drill string 105, a bottom hole assembly 108, and a drill bit 114.

In some implementations, a drilling assembly 112 can be deployed on a body of water rather than the terranean surface 111. For instance, in example implementations, the terranean surface 111 may be an ocean, gulf, sea, or any other body of water under which hydrocarbon-bearing formations may be found. Reference to the terranean surface 111 includes both land and water surfaces and contemplates forming and developing one or more wellbore systems 101 from either or both locations.

During drilling operations, the drill bit 114 and drill string 105 can encounter harsh downhole drilling conditions such as high temperatures and pressures as well as interfacing with the hard rock of the formations being drilled. Estimations of temperature, pressure, and other downhole or formation characteristics are useful to for planning and monitoring well drilling operations. Other useful information a during drilling operations includes a wellbore directional survey, which provides information of the shape of a borehole subsurface during or after drilling the respective wellbore section.

Microprocessor devices, or microchips 110, can be deployed into the wellbore system 101 to collect downhole data such as a wellbore directional survey, temperature profile, and pressure profile. Each microchip 110 can include one or more sensors. Sensors can include, for example, temperature sensors, pressure sensors, acoustic sensors, gyroscopic sensors, magnetometer sensors, and accelerometers. Sensor data can be collected from the microchips 110 in real time or after retrieving the microchips 110 from the wellbore system 101. The data can be used to analyze, control, monitor, and optimize aspects of the drilling operation. The microchips 110 are compact, lightweight, and stand-alone systems, and can be used to collect downhole in-situ sensor data.

In the wellbore system 101, a drilling fluid conduit, or pipe 106, transports drilling fluid from the pump 102 to the top drive 104. A dispenser apparatus 100 is connected to the pipe 106. The dispenser apparatus 100 is an automated apparatus for controlled initiation and release of microchips into the drilling assembly 112. The dispenser apparatus 100 is configured to insert the microchips 110 into the pipe 106. some examples, the dispenser apparatus 100 is configured to electrically charge the microchips 110 before release, to initiate the capture of sensor data by the microchips 110 before release, or both.

The microchips 110 can be released into the drilling assembly 112 at a portion of the pipe 106 that is located between the drilling fluid pump 102 and the top drive 104. A top drive is a mechanical device on a drilling rig that provides clockwise torque to the drill string to drill a borehole.

The portion of the pipe 106 where the dispenser apparatus 100 is attached can be above the terranean surface 111. The microchips 110 can be carried by the flow of the drilling fluid to reach the bottom of the drill string 105 at the bottom hole assembly 108. The microchips 110 can then travel through nozzles of the drill bit 114 and up through an annulus 122 of the wellbore 120. The microchips 110 continue to travel with the flow of the drilling fluid until reaching the surface 111. In some examples, after reaching the terranean surface 111, the microchips 110 are recovered for data download.

Figure 2:
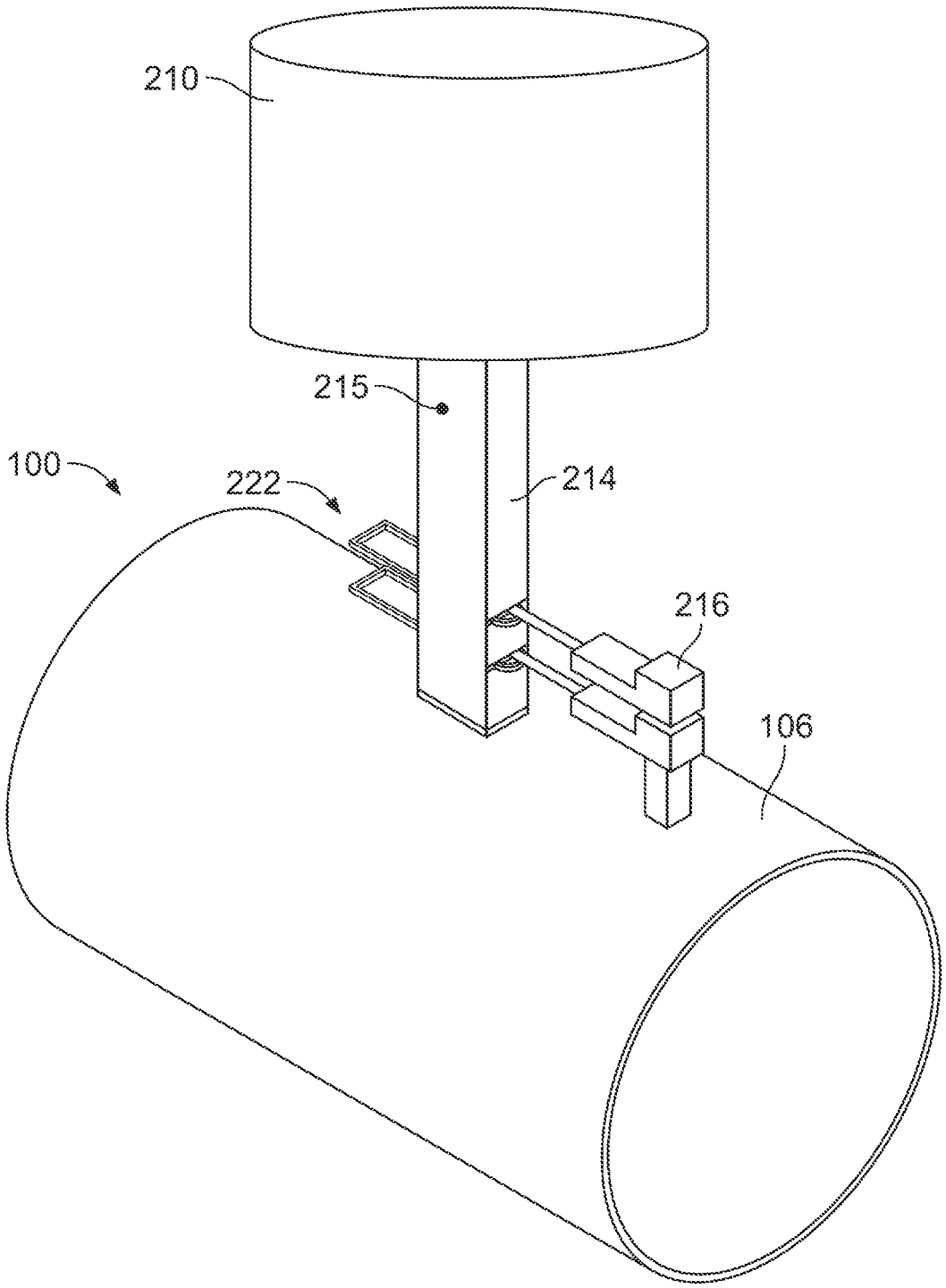
FIG. 2 illustrates an example dispenser apparatus connected to a drilling fluid conduit.

FIG. 2 illustrates an example dispenser apparatus 100 connected to a drilling fluid conduit, or pipe 106. The dispenser apparatus 100 is configured to controllably release microchips 110 into the pipe 106. The dispenser apparatus includes a container 214 and motor assembly 216. The motor assembly 216 operates release valves 222 to control release of microchips 110 into the pipe 106.

The dispenser apparatus 100 can store multiple microchips 110. In some examples, the dispenser apparatus 100 can electrically charge a power source of the microchips 110 when the microchips 110 are inside the container 214. The power source can be, for example, a battery. In some examples, the dispenser apparatus 100 includes an indicator 215 that indicates a charging level of the microchips 110 inside the container. For example, the indicator 215 can include an LED that illuminates to indicate whether the microchips are fully charged.

In some examples, the dispenser apparatus 100 can initiate the microchips 110 when the microchips 110 are inside the container 214. Initiating a microchip can cause the microchip to begin recording sensor data. In some examples, initiation of a microchip 110 includes sending a start signal to the microchip 110 to activate one or more sensors of the microchip. In some examples, the microchip 110 includes more than one sensor, and the dispenser apparatus initiates the microchip by sending a start signal to the microchip to activate all of the sensors of the microchip 110. In some examples, the microchip 110 includes more than one sensor, and the dispenser apparatus initiates the microchip by sending a start signal to the microchip to activate a subset of the sensors of the microchip 110.

In some examples, initiation of a microchip 110 can include electronically tagging the microchip by scanning the microchip and/or receiving a signal from the microchip. Tagging the microchip can include assigning an identifier to the microchip 110 so that sensor data received from the microchip 110 is associated with the identifier.

The dispenser apparatus 100 deploys the microchips 110 into the drilling fluid pipe 106 in a controllable manner. In some examples, the dispenser apparatus 100 inserts the microchips 110 into the pipe 106 at predetermined rates of insertion. In some examples, the dispenser apparatus 100 inserts the microchips 110 into the pipe 106 at predetermined times.

In some examples, the dispenser apparatus 100 is connected to a vessel 210. The vessel 210 can be a receptacle for storing the microchips 110 before the microchips 110 are loaded into the container 214. The vessel 210 may be larger than the container 214.

In some examples, the container 214 is fixedly attached to the pipe 106. In some examples, the container 214 is detachable from the pipe 106. For example, the container 214 can be removable from the pipe 106 such that the container 214 can be removed for maintenance, refilling, and/or replacement.

In some examples, a control system (not shown) is communicably coupled to the dispenser apparatus 200. The control system can be configured to operate the dispenser apparatus 200 to automatically insert microchips 110 into the pipe 106 at controlled rates of insertion. The rates of insertion can be constant or variable. A rate of insertion can be, for example, one microchip per minute, ten microchips per minute, one hundred microchips per hour, one thousand microchips per hour.

Figure 3:
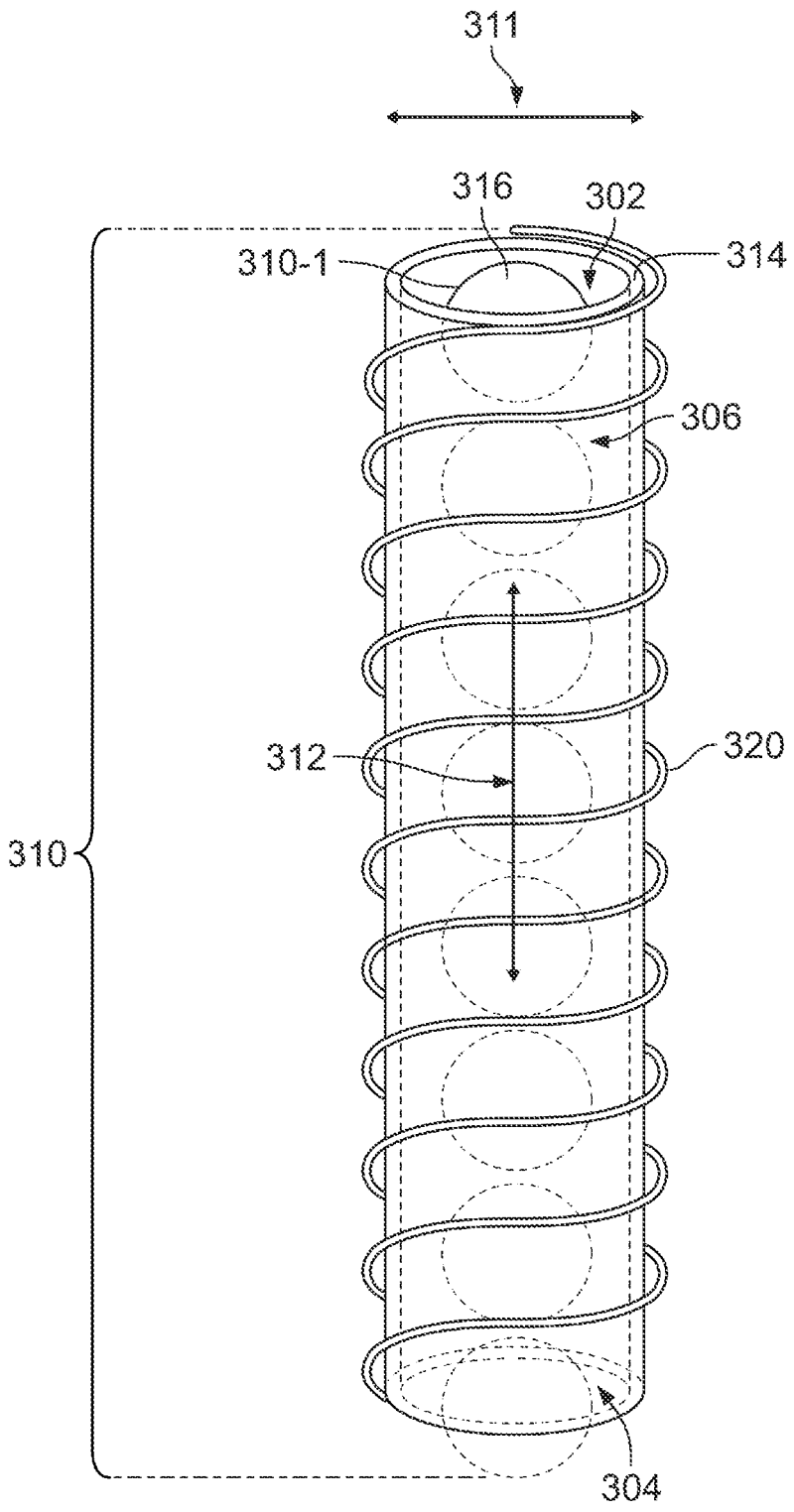
FIG. 3 illustrates an example cylindrical container of a dispenser apparatus.

FIG. 3 illustrates an example cylindrical container 314 of a dispenser apparatus. The container 314 defines an interior volume 306. An inlet 302 provides access for entry of the microchips 310 into the interior volume 306. An outlet 304 provides egress for passage of the microchips 310 out of the container 314 and into a drilling fluid pipe.

In some examples, the inlet 302 has a higher elevation than the outlet 304 when the container 314 is attached to the pipe. Movement of the microchips 310 through the interior volume 306 from the inlet 302 to the outlet 304 is assisted by gravity. Movement of the microchips 310 through the outlet 304 to the pipe is assisted by gravity.

In some examples, a cylindrical axis 312 of the container 314 has a vertical or near-vertical orientation when the container 314 is connected to a drilling fluid pipe, such that the microchips 310 travel parallel or approximately parallel to a direction of gravity between the inlet 302 and the outlet 304. In some examples, the cylindrical axis 312 of the container 314 has a horizontal or near horizontal orientation when the container 314 is connected to a drilling fluid pipe. Other orientations are possible, such as diagonal orientations with respect to the direction of gravity.

The example container 314 is sized to contain eight microchips. Containers can be sized to contain more or fewer microchips. For example, containers can be sized to fit tens, dozens, hundreds, or thousands of microchips. In some examples, when the microchips 310 are inside the interior volume 306 of the container 314, the microchips 310 are in contact with each other. In some examples, when the microchips 310 are inside the interior volume 306 of the container 314, the microchips 310 are not in contact with each other. For example, the container 314 can include separators that prevent the microchips 310 from contacting each other inside the interior volume 306.

The example container 314 is sized to contain microchips 310 inside the interior volume 306 such that the microchips 310 are stacked end-to-end between the inlet 302 and the outlet 304. For example, the cylindrical diameter 311 of an inner wall of the container 314 is larger than a diameter of one microchip 310, and is smaller than two times the diameter of one microchip 310.

The container 314 contains microchips 310, including microchip 310-1. The microchips 310 can be uniform in size, shape, or both. In the example of FIG. 3, the microchips 310 are uniform in size and shape. The microchips 310 have a substantially spherical shape. In some examples, the microchips 310 each contain a sensor of a same sensor type. For example, the microchips 310 can each include a temperature sensor. In some examples, the microchips 310 contain sensors of different sensor types. For example, a subset of the microchips 310 can contain temperature sensors, and a subset of the microchips 310 can contain pressure sensors.

The microchip 310-1 includes a power source. The microchip 310-1 includes one or more sensors configured to generate sensor data indicating downhole conditions of a well. In some examples, the microchip 310-1 is configured to wirelessly transmit the sensor data to a computer at a terranean surface 111.

The microchip 310-1 includes a casing 316 enclosing an interior region of the microchip. A diameter of the casing 316 can be twenty millimeters or less (e.g., fifteen millimeters or less, ten millimeters or less). The microchip 310-1 can include a printed circuit board disposed within the interior region of the microchip.

An electrical coil 320 wraps around the cylindrical container 314. The electrical coil 320 can be part of a charging circuit, an initiation circuit, or both. The electrical coil 320 is configured to electrically charge and/or initiate the microchips 310 when the microchips 310 are within the interior volume 306. For example, the microchips 310 can be charged and/or initiated when the microchips 310 are inside the interior volume 306 and electrical current flows through the electrical coil 320 around the container 314.

In some examples, the electrical coil 320 is wound around an outside wall of the container 314. In some examples, the electrical coil 320 is positioned along an inner wall of the container 314. In some examples, the electrical coil 320 is integrated or embedded within the wall of the container 314.

Figure 4A:
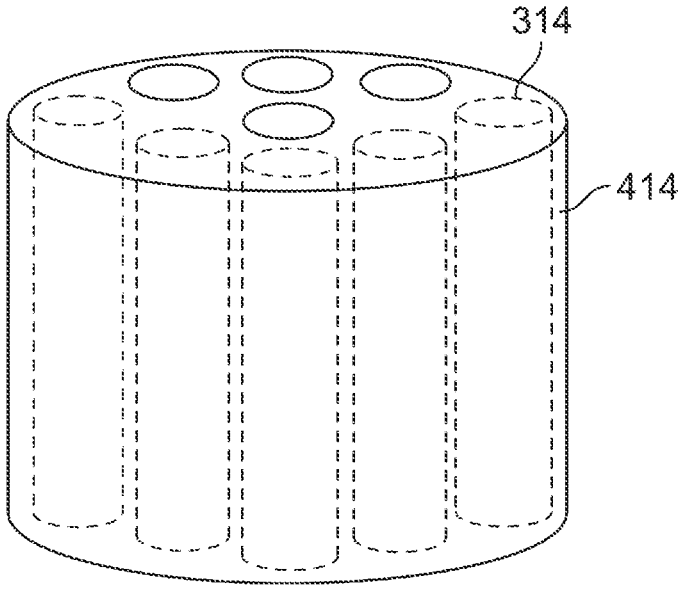
FIGS. 4A and 4B illustrate an example casing for cylindrical containers of a dispenser apparatus.
Figure 4B:
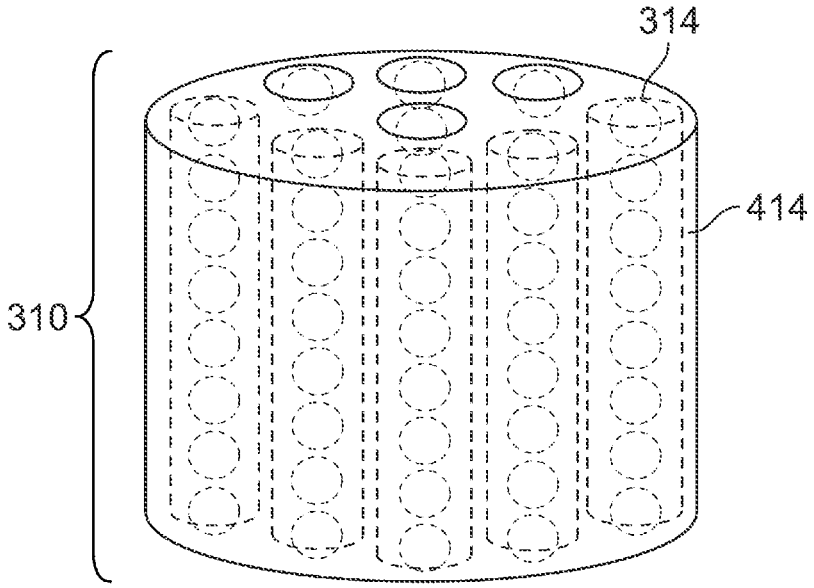

FIGS. 4A and 4B illustrate an example casing 414 for cylindrical containers 314 of a dispenser apparatus. Referring to FIG. 4A, the casing 414 can contain multiple containers 314, including the respective electrical circuits for charging and/or initiation. In some examples, multiple containers in the casing 414 can have shared electrical circuits. In some examples, all of the containers 314 in the casing 414 are charged and/or initiated by the same electrical circuit.

Referring to FIG. 4B, each container can contain multiple microchips 310. The casing 414 can be mounted to the pipe 106. The casing 414 can provide sealing to prevent fluid leakage. The casing 414 can withstand high temperatures and pressures. The casing 414 can prevent microchips 310 from escaping the containers 314.

Figure 5A:
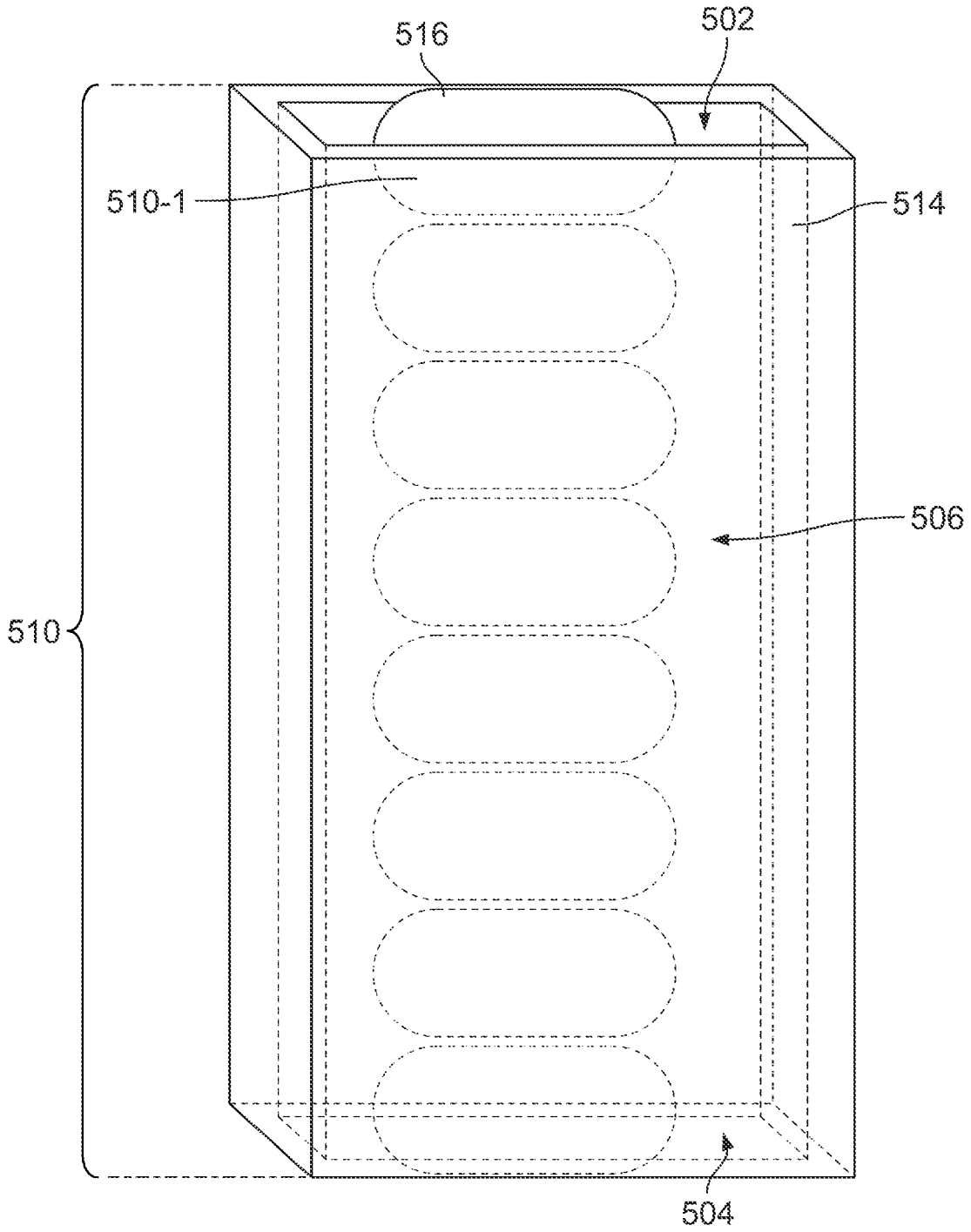
FIG. 5A illustrates an example prismatic container of a dispenser apparatus.

FIG. 5A illustrates an example prismatic container 514 of a dispenser apparatus. The container 514 defines an interior volume 506. An inlet 502 provides access for entry of the microchips 510 into the interior volume 506. An outlet 504 provides egress for passage of the microchips 510 out of the container 514 and into a drilling fluid pipe.

The container 514 contains microchips 510, including microchip 510-1. The microchips 510 can be uniform in size, shape, or both. In the example of FIG. 5A, the microchips 510 are uniform in size and shape. The microchips 510 have a substantially ellipsoid shape.

Figure 5B:
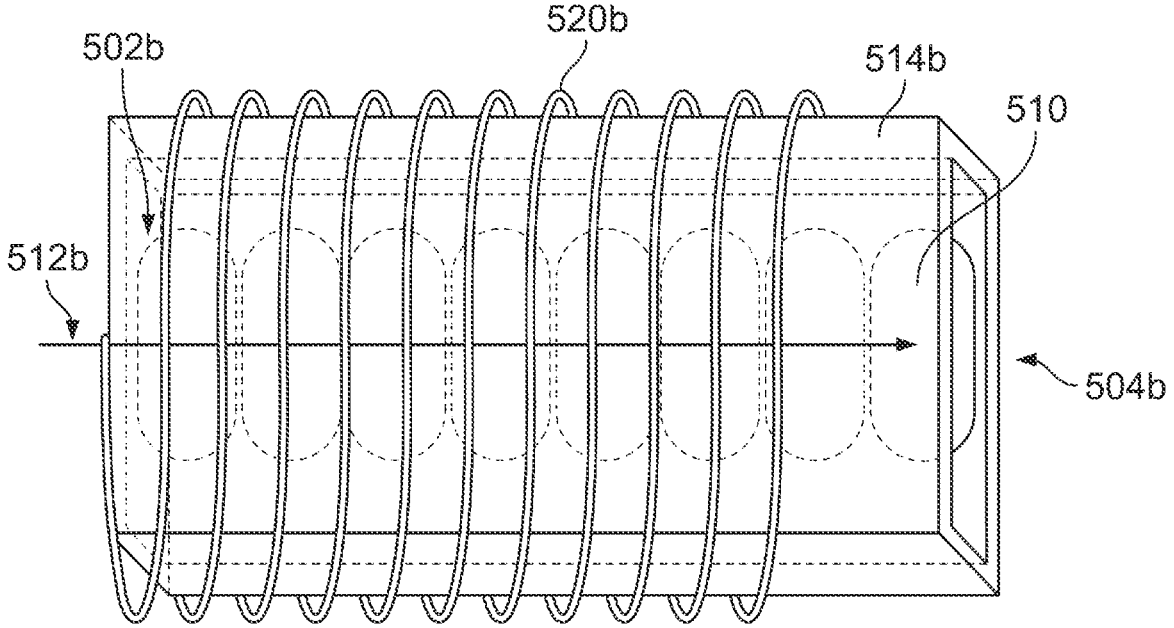
FIGS. 5B and 5C illustrate example prismatic containers of a dispenser apparatus with inlets and outlets.
Figure 5C:
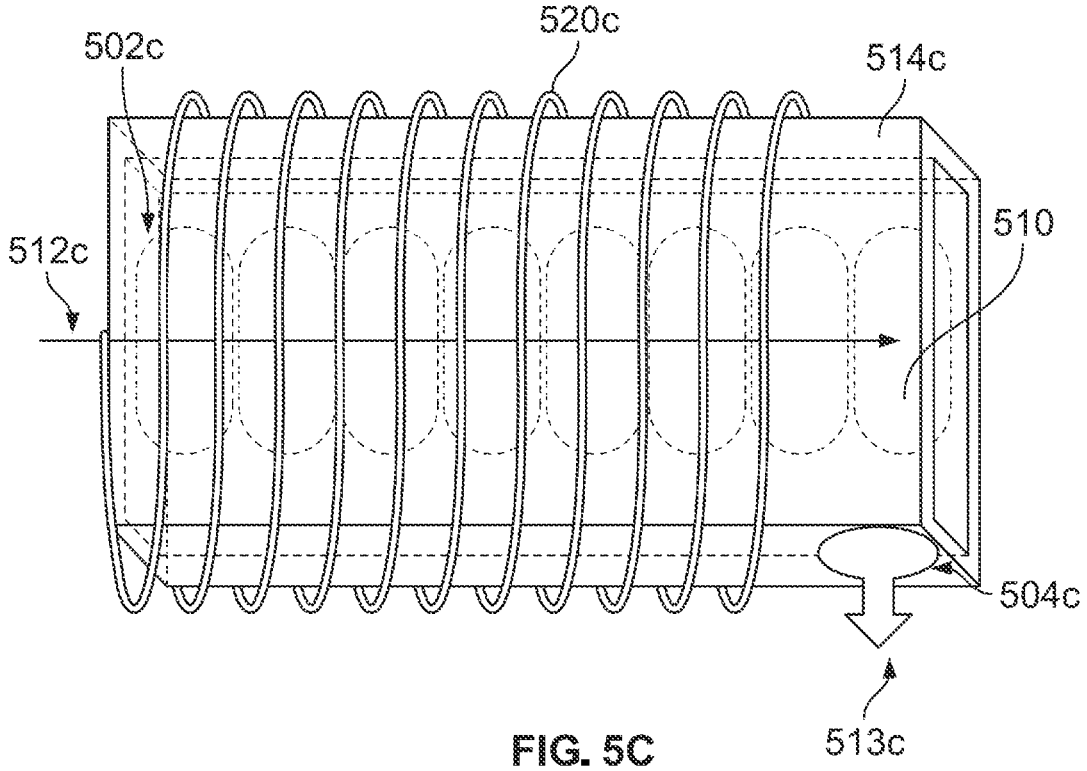

FIGS. 5B and 5C illustrate example prismatic containers of a dispenser apparatus with inlets and outlets. FIG. 5B shows a prismatic container 514*b* with an inlet 502*b* at a first side of the container 514*b* and an outlet 504*a* at an opposite side of the container 514. The microchips 510 travel from the inlet 502*a* to the outlet 504*a* in a direction of arrow 512*b*. When the microchips 510 are inside the container 514*b*, the microchips 510 are charged and/or initiated by the electrical coil 520*b*.

FIG. 5C shows a prismatic container 514*c* with an inlet 502*c* at a first side of the container 514*c* and an outlet 504*c* at an adjacent side of the container 514*c*. The microchips 510 travel through the container 514*c* from the inlet 502*c* in a direction of arrow 512*c*. The microchips 510 exit the container 514*c* by traveling in a direction of arrow 513*c* through the outlet 504*c*. When the microchips 510 are inside the container 514*c*, the microchips 510 are charged and/or initiated by the electrical coil 520*b*.

Figure 6A:
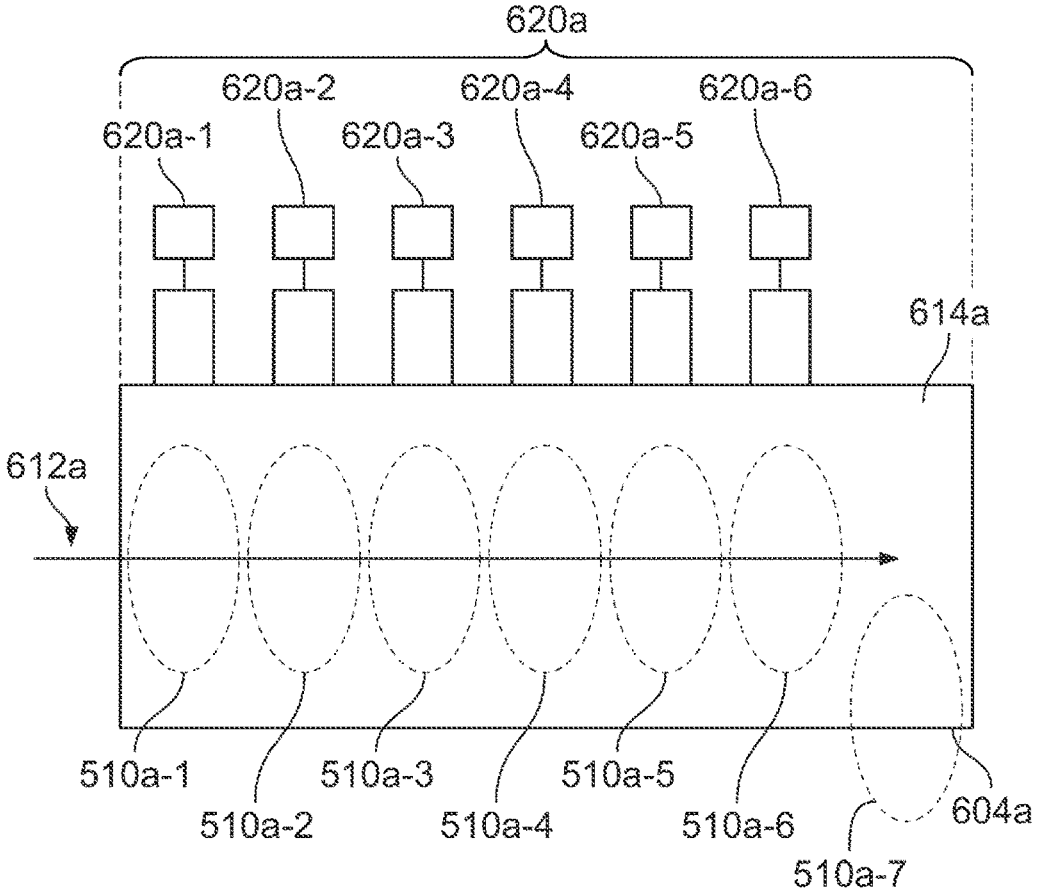
FIGS. 6A and 6B illustrate example containers with charging circuits and initiation circuits.
Figure 6B:
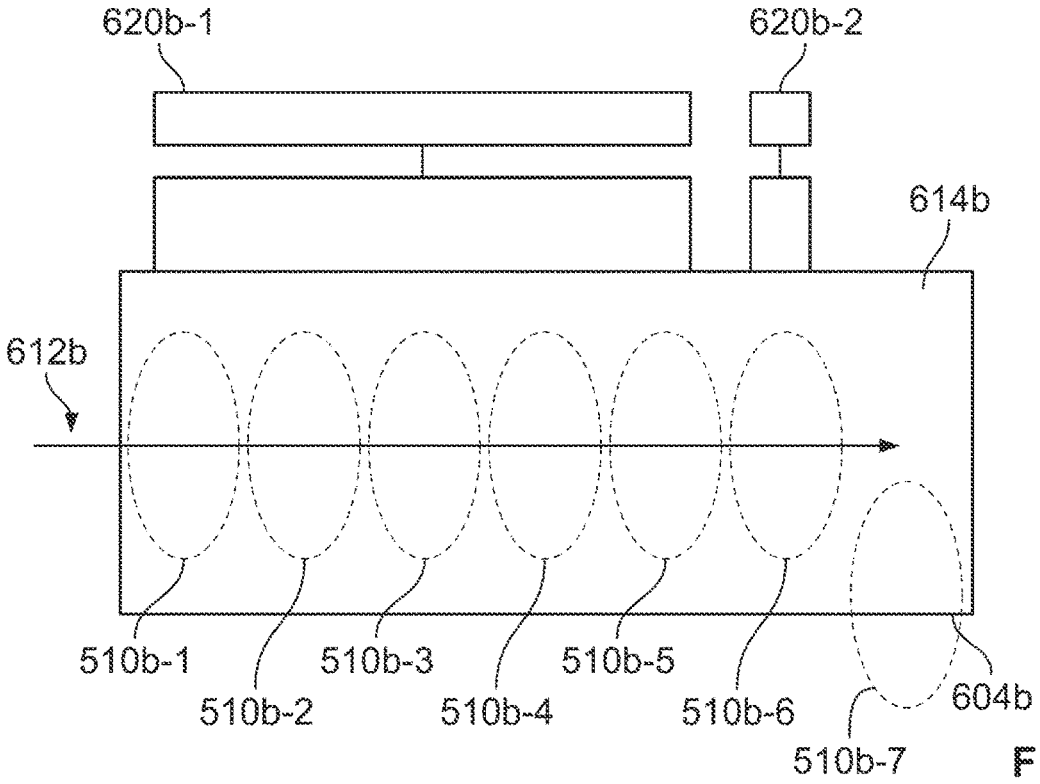

FIGS. 6A and 6B illustrate example containers 614*a*, 614*b* of dispenser apparatuses including charging circuits and initiation circuits. Microchips 510 can be charged and/or initiated by energization of electrical circuits. In some examples, the microchips 510 are charged wirelessly by a transmitter coil. In some examples, the electrical circuit includes a wired power source, a battery, and/or a generator such as a piezoelectric generator. Prior to release from the dispenser apparatus, the microchips can be initiated as a group or individually. The microchips can be initiated wirelessly through a control circuit and a transmitter coil.

FIG. 6A shows an example container 614*a* containing microchips 510*a*-1 to 510*a*-7. The container 614*a* is in electrical communication with wireless electrical circuits

620*a*-1 to 620*a*-6. The microchips 510*a* can each be charged and initiated by an individual circuit 520. After charging and initiation, the microchips 510*a* can be released sequentially through an outlet 604*a*.

For example, microchips 510*a*-1 through 510*a*-6 can each be charged and/or initiated by a respective circuit 620*a*-1 through 620*a*-6. After charging and/or initiation, the stacked microchips can travel in the direction of arrow 612*a*. The microchip 510*a*-6 can be released through the outlet 604*a*, followed by microchip 510*a*-5, 510*a*-4, etc. In some examples, the charging and/or initiation occurs simultaneously. In some examples, the charging and/or initiation occurs sequentially.

FIG. 6B shows an example container 614*b* containing microchips 510*b*-1 to 510*b*-7. The container 614*b* is in electrical communication with wireless electrical circuits 620*b*-1 and 620*b*-2. The circuit 620*b*-1 is a charging circuit, and the circuit 620*b*-2 is an initiation circuit. The microchips 510 are charged by the charging circuit 620*b*-1. After charging, each microchip 510 is initiated by the initiation circuit 620*b*-2. After a microchip is initiated by the initiation circuit 620*b*-2, the microchip can be released through an outlet 604*b*.

For example, microchips 510*b*-1 through 510*b*-5 can be charged by charging circuit 620*b*-1, and the microchip 510*b*-6 can be initiated by the initiation circuit 620*b*-2. The stacked microchips can then travel in the direction of arrow 612*b*. The microchip 510*b*-6 can be released through the outlet 604*b*, while the microchip 510*b*-5 is initiated by the initiation circuit 620*b*-2, and the microchips 510*b*-4, 510*b*-3, 510*b*-2, 510*b*-1 continue to charge.

Figure 7:
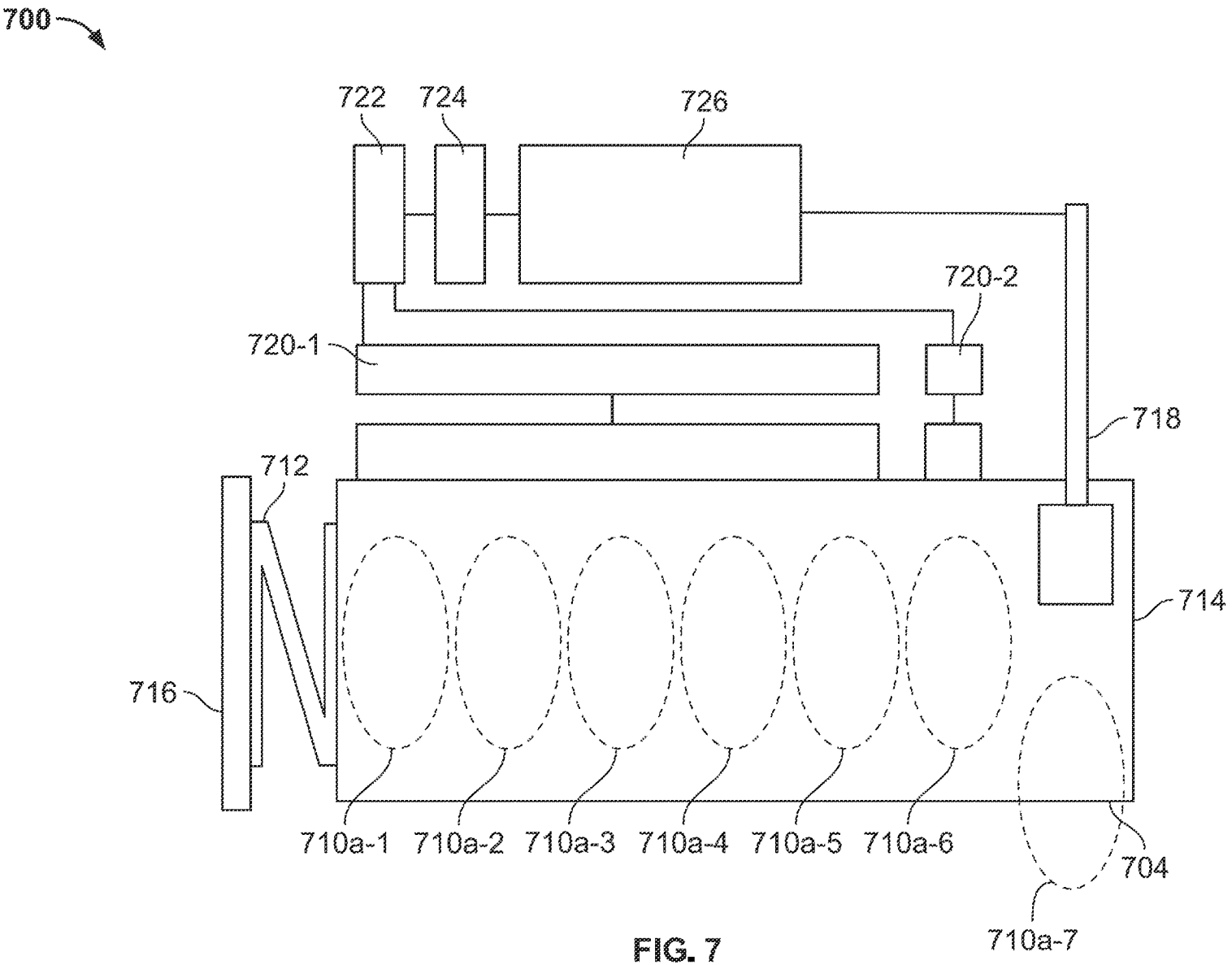
FIG. 7 illustrates an example container of a dispenser apparatus with a loading mechanism and a release mechanism.

FIG. 7 illustrates an example dispenser apparatus 700. The dispenser apparatus 700 includes a power source 722, a controller 724, an actuator 726, and a release mechanism 718.

The dispenser apparatus 700 includes a container 714 with an inlet 702 and outlet 704. The container 714 contains microchips 710. The container 714 is in electrical communication with electrical circuits 720-1, 720-2.

The dispenser apparatus 700 includes a loading device 712. The loading device 712 can include a mechanical loading mechanism such as a spring. The spring is compressed to close the full container 714. The spring is held in place by a cap 716. The loading device 712 is configured to exert a force on the microchips 710. Movement of the microchips 720 through the interior volume is assisted by the exerted force. In some examples, the microchips 710 are stacked such that displacement of a first microchip causes displacement of a second microchip. For example, the microchips 710 are horizontally stacked. Displacing a first microchip 710*a*-1 exerts a force on a second microchip 710*a*-2 and displaces the second microchip 710*a*-2.

As microchips 710 are released from the container 714, the spring expands, pushing the microchips 710 to fill gaps left by the released microchips 710. When the container 714 is empty, the cap 716 can be removed and the container 714 can be refilled with microchips entering through the inlet 702.

The dispenser apparatus 700 includes a release mechanism 718. The release mechanism 718 can include an electromechanical device such as an electrically controlled piston or ram. The release mechanism controllably releases the microchips 710 from the container 714 through the outlet 704 into the drilling fluid system.

The dispenser apparatus 700 includes the controller 724. The controller 724 can be, for example, a printed circuit board (PCB). The controller 724 can control the charging, initiation, loading, and/or release of microchips in the container 714. The controller 724 can control the initiation of the microchips to occur just before release of the microchips into the drilling fluid system. For example, a time between initiation of a microchip and release of the microchip into the drilling fluid system can be several seconds or less (e.g., three seconds or less, one second or less, one-half second or less).

In some examples, the controller 724 controls the charging, initiation, loading, and/or release of microchips from multiple containers within a same casing. In some examples, the controller 724 includes a timer and a counter to keep track of the number of microchips released, identifiers of released microchips, and time of release.

The controller 724 controls the actuator 726 to release microchips from the container 714 using the release mechanism 718. The actuator 726 can be, for example, a motor.

The release mechanism 718 can include a piston, such as an electromechanical piston. The electromechanical piston is operable to exert a force on a microchip (e.g., microchip 710*a*-7) at the outlet 704. Movement of the microchip 710*a*-7 through the outlet 704 is assisted by the exerted force. In some examples, movement of the microchip 710*a*-7 through the outlet 704 is assisted by gravity. When the microchip 710*a*-7 exits the container 714 through the outlet 704, the microchip 710*a*-6, which has been initiated by initiation circuit 720-2, moves towards the outlet 704 due to the force from the loading device 712 and the stacked microchips 710*a*-1 to 710*a*-5*d*. The release mechanism 718, controlled by the controller 724 via the actuator 726, then pushes the microchip 710*a*-6 out of the container 714 through the outlet 704.

Figure 8A:
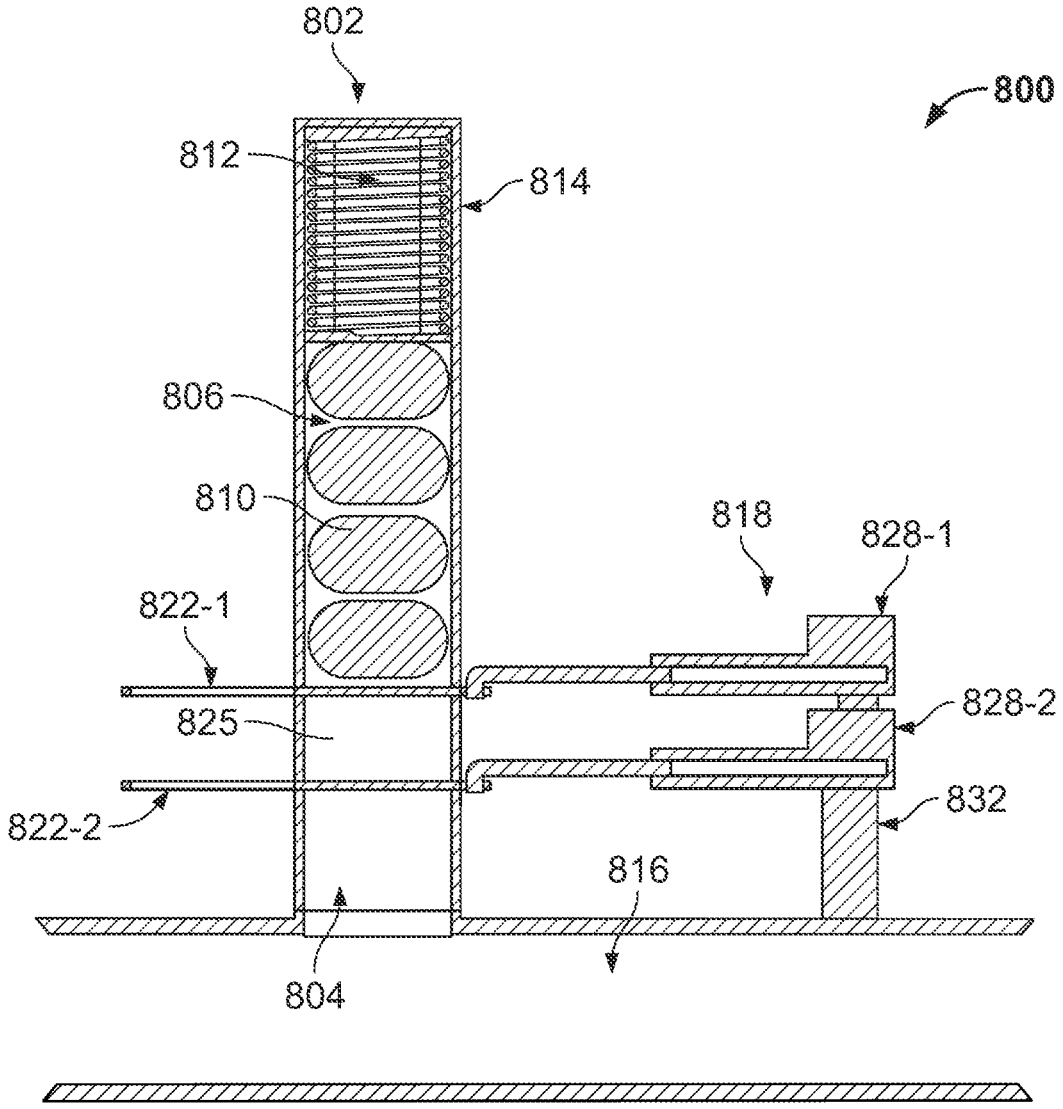
FIG. 8A illustrates an example dispenser apparatus including a container and a release mechanism for dispensing microchips sequentially.

FIG. 8A illustrates an example dispenser apparatus 800 including a container 814 and release mechanism 818 for dispensing microchips 810 sequentially. The dispenser apparatus 800 includes the container 814 defining an interior volume 806. The container 814 has an inlet 802 and an outlet 804. A loading device 812, such as a compressed spring, exerts a force on the microchips 810 inside the container 814.

The release mechanism 818 includes a first valve 822-1, a second valve 822-2, a first motor 828-1, a second motor 828-2, and an anchor 832. The first motor 828-1 and the second motor 828-2 can each be a linear motor. The motor 828-1 is mechanically coupled to the valve 822-1 and is operable to move the valve 822-1 relative to an outlet 804. The motor 828-2 is mechanically coupled to the valve 822-2 and is operable to move the valve 822-2 relative to the outlet 804. The anchor 832 and the container 814 are attached to a wall of a drilling fluid pipe 816. The first valve 822-1 and the second valve 822-2 define a chamber 825 within the container 814.

The dispenser apparatus 800 controllably deploys the microchips 810 to the drilling fluid pipe 816, which can have higher pressure and/or higher temperature compared to the container 814. The loading device 812 pushes a microchip 810 into the chamber 825, and the microchip is then released into the drilling fluid pipe 816. An example process for releasing microchips from the container 814 into the drilling fluid pipe 816 is shown and described with reference to FIGS. 9A to 9E.

Figure 8B:
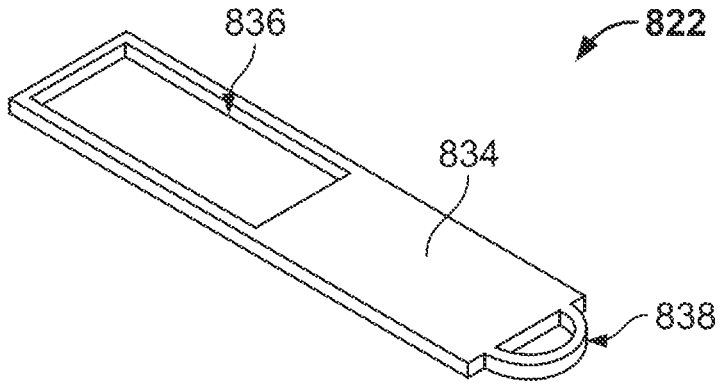
FIG. 8B illustrates an example mechanical valve for the release mechanism of FIG. 8A.

FIG. 8B illustrates an example valve 822 of the release mechanism of FIG. 8A. The valve 822 includes a plate 834 defining an aperture 836. The valve 822 includes a push-pull joint 838. The valve 822 can be operated to seal microchips inside the container 814 at some times, and to release microchips from the container 814 at other times.

The plate 834 functions as a sealing partition. When aligned with the outlet 804, the plate 834 forms a mechanical barrier to prevent the microchips from egressing from the container 814 through the outlet 804. The plate 834, when aligned with the outlet 804, can also prevent the drilling fluid from flowing into the container 814.

The aperture 836, when aligned with the outlet 804, permits microchips to egress from the container 814 through the outlet 804. When aligned with the outlet 804, the aperture 836 also allows drilling fluid to enter the container 814 from the pipe 816.

The push-pull joint 838 can be mechanically coupled to an actuator such as a motor 828-1 or 828-2. The actuator can push the push-pull joint 838 to shut the valve by moving the valve 822 away from the actuator to align the plate 834 with the outlet 804. The actuator can pull the push-pull joint 838 to open the valve by moving the valve 822 towards the actuator to align the aperture 836 with the outlet 804.

FIGS. 9A to 9E illustrate example steps of a release sequence for dispensing microchips sequentially from the dispenser apparatus 800 using the motors 828-1, 828-2.

Referring to FIG. 9A, the container 814 contains microchips 810, including microchip 810-1 and microchip 810-2. When the microchips 810 are loaded into the container 814, the loading device 812 is loaded under compression. For example, the loading device 812 can be a spring that is compressed when the container 814 contains microchips 810. In some examples, a greater number of microchips 810 in the container 814 causes a greater amount of compression of the spring.

Referring to FIG. 9B, the first motor 828-1 pulls the valve 822-1 to an open position by aligning the aperture 836 of the valve 822-1 with the outlet 804.

Referring to FIG. 9C, the microchip 810-1 enters the chamber 825 through the aperture of the valve 822-1. Movement of the microchip 810-1 into the chamber 825 is assisted by a force exerted from the loading device 812 onto stacked microchips 810 in the container 814. In some examples, movement of the microchip 810-1 into the chamber 825 is assisted by gravity. When the microchip 810-1 moves into the chamber 825, the microchip 810-2, and other microchips in the container 814, move towards the chamber 825.

Referring to FIG. 9D, the loading device 812 expands due to the displacement of the microchips 810 towards the chamber 825. The first motor 828-1 pushes the valve 822-1 to a closed position by aligning the plate 834 of the valve 822-1 with the outlet 804. The second motor 828-2 pulls the valve 822-2 to an open position by aligning the aperture 836 of the valve 822-2 with the outlet 804. The microchip 810-1 exits the chamber 825 through the aperture 826 of the valve 822-2. The microchip 810-1 then exits the container 814 through the outlet 804 and enters the pipe 816. When the valve 822-2 is open, drilling fluid may enter the chamber 835.

Referring to FIG. 9E, the second motor 828-2 pushes the valve 822-2 to a closed position. The valves 822-1, 822-2 form a double barrier between the microchip 810-2 and the drilling fluid pipe 816. The chamber 825 can include a drainage hole through which drilling fluid can drain away from the chamber 825. Draining fluid from the chamber 825 reduces the likelihood of drilling fluid entering the container 814 when the valve 822-1 is opened to permit movement of the microchip 810-2 into the chamber 825.

The process shown in FIGS. 9A to 9E can repeat for additional microchips, such as microchip 810-2. Operations of the motors 828-1, 828-2 can be automatically controlled by a controller. For example, referring to FIG. 7, the motors 828-1, 828-2 can each be an actuator 726 that is controlled by controller 724. The controller 724 can operate the motors 828-1, 828-2 to controllably release the microchips 810 into the drilling fluid pipe 816 at designated times and/or designated rates of insertion.

Figure 10:
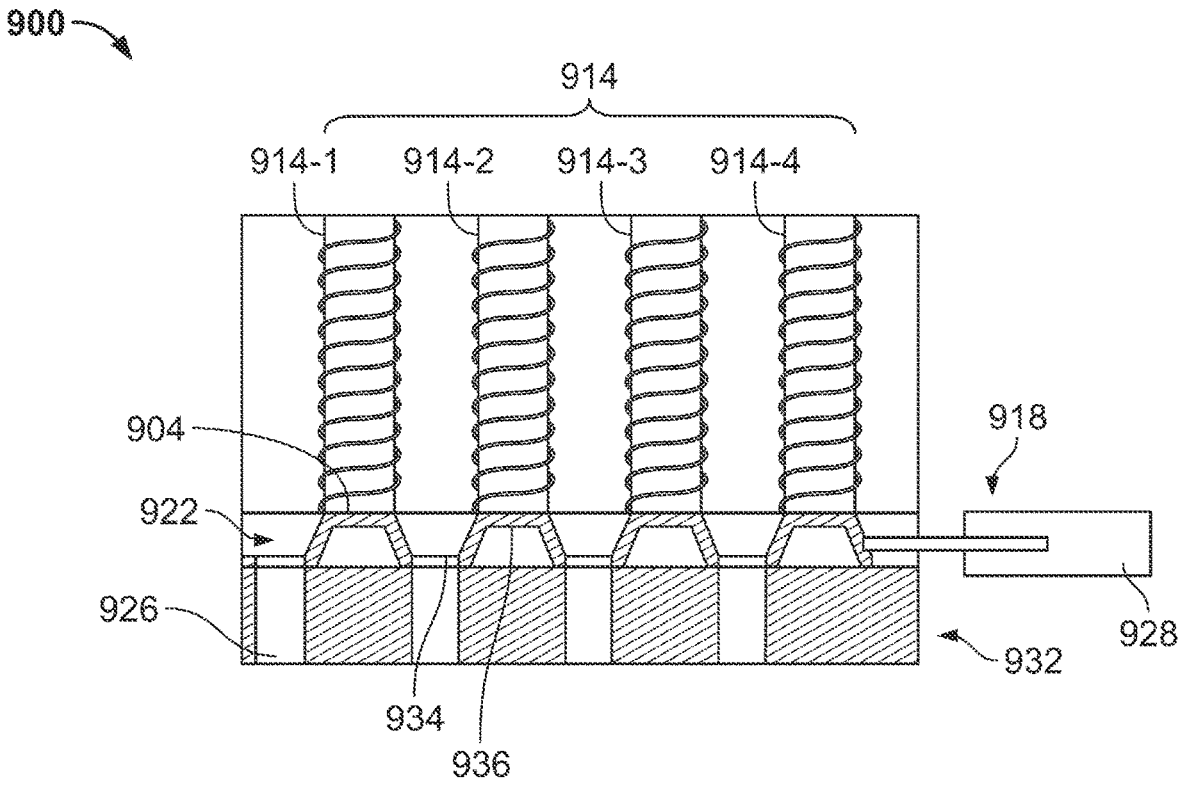
FIG. 10 illustrates an example dispenser apparatus including containers and a release mechanism for dispensing microchips simultaneously.

FIG. 10 illustrates an example dispenser apparatus 900 including containers 914 and a release mechanism 918 for dispensing multiple microchips simultaneously. Each container has an outlet 904. The dispenser apparatus includes multiple containers 914. The containers 914 can be within a casing such as the casing 414 of FIGS. 4A and 4B. The dispenser apparatus 900 includes a plate 932 defining through holes 926. The through holes 926 are offset from the containers 914.

The release mechanism 918 includes an actuator 928 coupled to a selection device 922. The actuator 928 can be, for example, a motor configured to push and pull the selection device 922 in order to move the selection device 922 relative to the actuator 928, the containers 914, and the plate 932.

The selection device 922 includes peaks 936 and troughs 934. The peaks 936 are raised portions of the selection device 922 that, when aligned with the container outlets 904, prevent microchips from exiting through the outlets 904. The troughs 934 are recessed portions of the selection device 922 that, when aligned with the container outlets 904, permit microchips to exit through the outlets 904 into the troughs. In some examples, when the troughs 934 of the selection device 922 align with the outlets 904 of the containers 914, each trough 934 permits one microchip to exit the respective container 914 into the trough 934.

In some examples, each trough 934 includes an aperture. When a trough 934 aligns with a through hole 926 of the plate 932, and the trough 934 contains a microchip 910, the microchip passes through the aperture of the trough 934 into the through hole 926. In this way, the selection device 922 conveys microchips from the containers 914 to the through holes 926. The plate 932 can be attached to a drilling fluid pipe such that the microchips 910 move through the through holes 926 into the drilling fluid pipe.

FIGS. 11A to 11G illustrate example steps of a release sequence for dispensing microchips simultaneously from the dispenser apparatus 900 using the selection device 922.

Figure 11A:
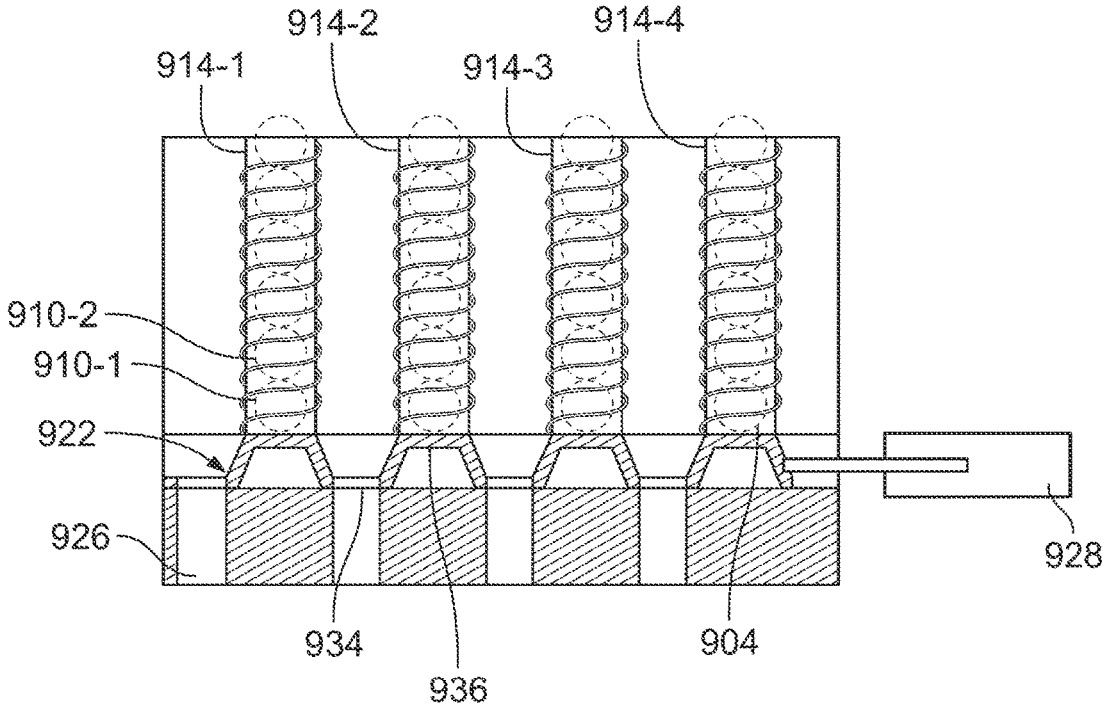
FIGS. 11A to 11G illustrate example steps of a release sequence for dispensing microchips simultaneously.

Referring to FIG. 11A, the containers 914 contain microchips 910, including microchip 910-1 and microchip 910-2. Peaks 936 of the selection device 922 seal the outlets of the containers 914, preventing the microchips 910 from exiting the containers 914.

Figure 11B:
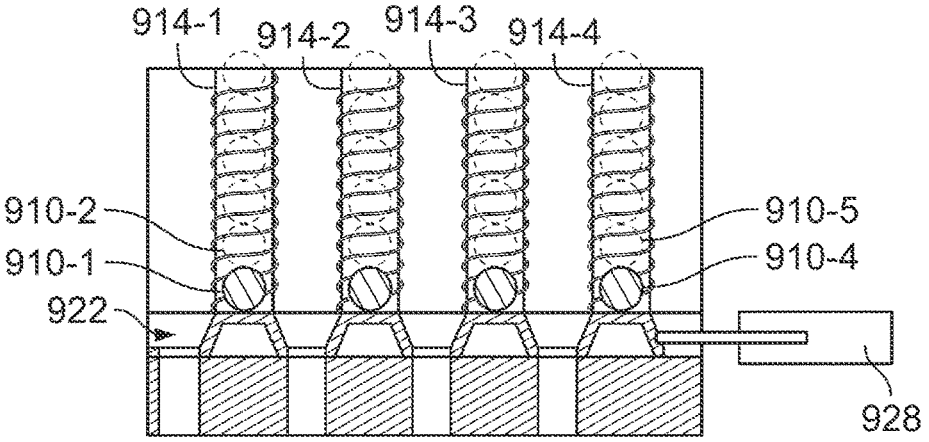

Referring to FIG. 11B, microchips positioned at the outlets of the containers 914, such as microchip 910-1 in container 914-1 and microchip 910-4 in container 914-4, are initiated prior to releasing the microchips from the containers 914.

Figure 11C:
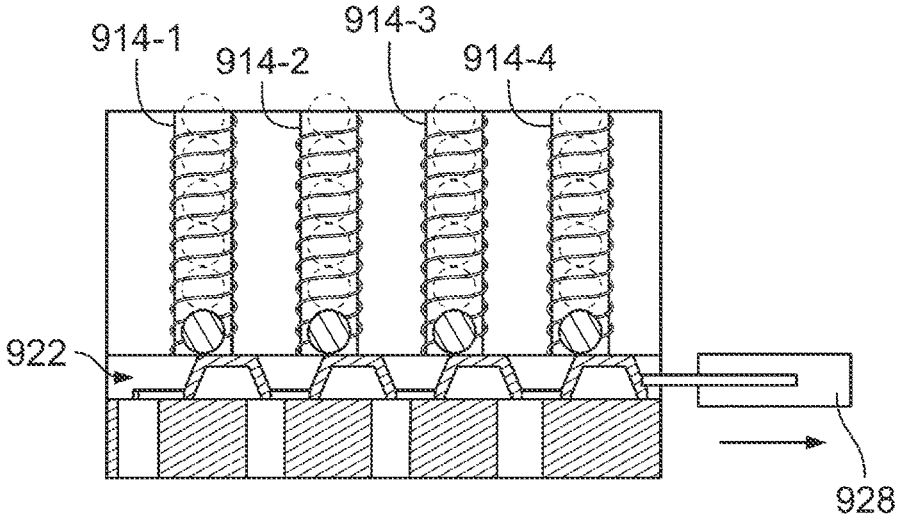

Referring to FIG. 11C, the actuator 928 drives the selection device 922 by pulling the selection device 922 towards the actuator 928. When the selection device 922 moves relative to the containers 914, the peaks 936 no longer seal the outlets of the containers 914.

Figure 11D:
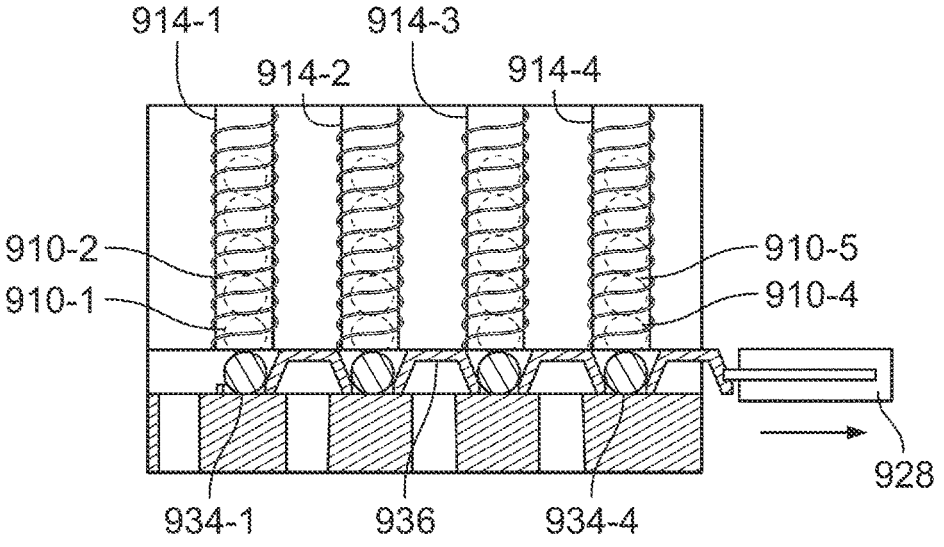

Referring to FIG. 11D, the actuator 928 continues to pull the selection device 922 towards the actuator 928, aligning the troughs 934 of the selection device 922 with the containers 914. In some examples, each trough 934 of the selection device 922 aligns with a respective container 914, and one microchip 910 from each container 914 moves into the respective trough 934. For example, the trough 934-1 aligns with the container 914-1, and the microchip 910-1 moves from the container 914-1 into the trough 934-1. Similarly, the trough 934-4 aligns with the container 914-4, and the microchip 910-4 moves into the trough 934-4.

The remaining microchips 910 in the containers 914 (e.g., microchip 910-2 and microchip 910-5) move towards the outlets 904 of the respective containers 914. Movement of the microchips towards and through the outlets 904 can be assisted by gravity, by a loading device (not shown), or both. In some examples, the troughs are sized to fit more than one microchip (e.g., two microchips, three microchips), such that more than one microchip exits from a container into the respective trough 934.

Figure 11E:
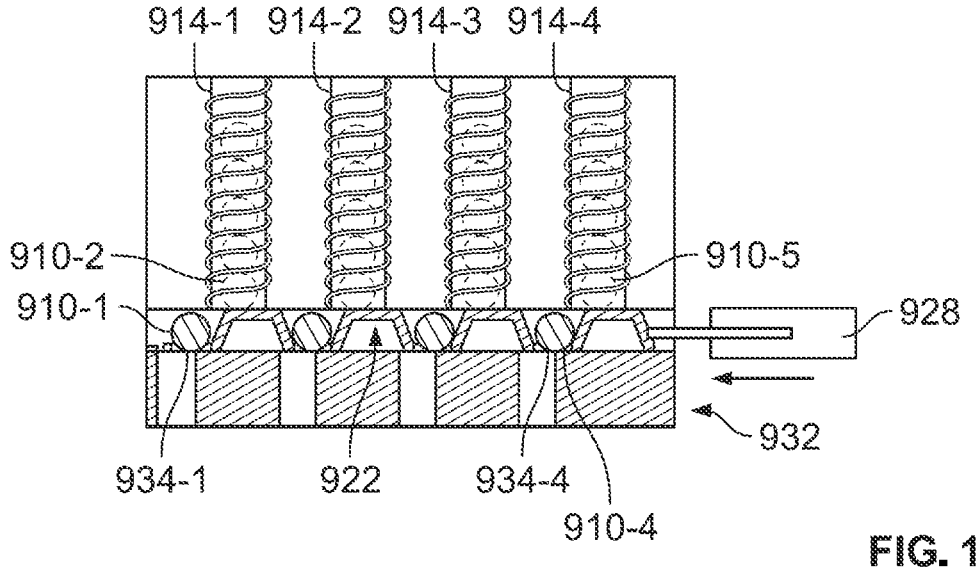

Referring to FIG. 11E, the actuator 928 drives the selection device 922 by pushing the selection device 922 away from the actuator 928. When the selection device 922 moves relative to the containers 914, the troughs 934 no longer align with the containers 914. For example, the trough 934-1 no longer aligns with the container 914-1, and the trough 934-4 no longer aligns with the container 914-4.

Figure 11F:
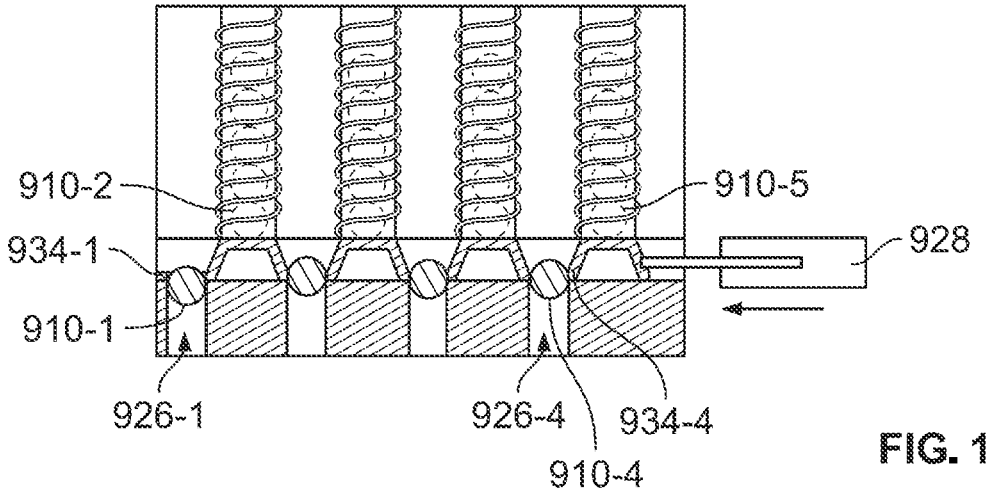

Referring to FIG. 11F, the actuator 928 continues to push the selection device 922 away from the actuator 928, aligning the troughs 934 of the selection device 922 with the through holes 926 of the plate 932. For example, the trough 934-1 aligns with through hole 926-1, and the trough 934-4 aligns with through hole 926-4.

Figure 11G:
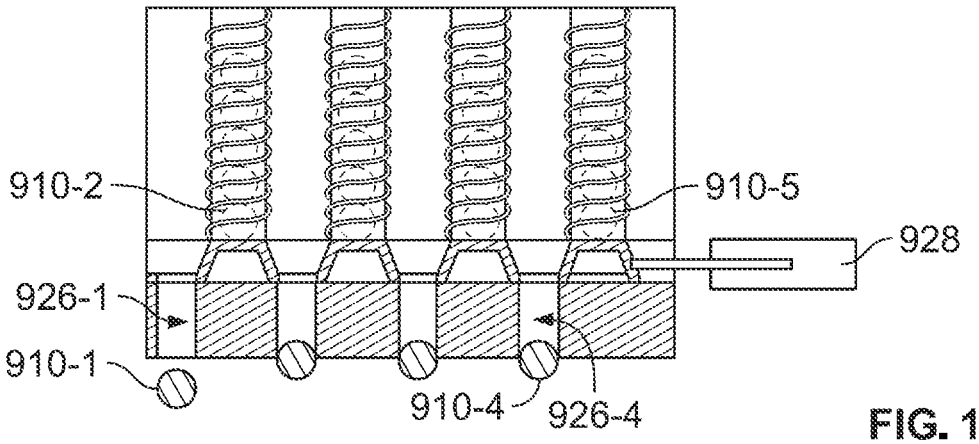

Referring to FIG. 11G, the microchips 910 are released through the through holes 926 into a drilling fluid pipe (not shown). For example, the microchip 910-1 passes through the through hole 926-1. The microchip 910-4 passes through the through holes 926-4. The microchips 910-1 and 910-4 can thus be inserted into the drilling fluid pipe simultaneously or near simultaneously (e.g., during a same cycle of movement of the selection device 922).

The process shown in FIGS. 11A to 11G can repeat for additional microchips, such as microchips 910-2 and 910-5. Operations of the actuator 928 can be automatically controlled by a controller. For example, referring to FIG. 7, the actuator 928 can be controlled by the controller 724. The controller 724 can operate the actuator 928 to controllably release the microchips 910 into the drilling fluid pipe at designated times and/or designated rates of insertion.

Figure 12:
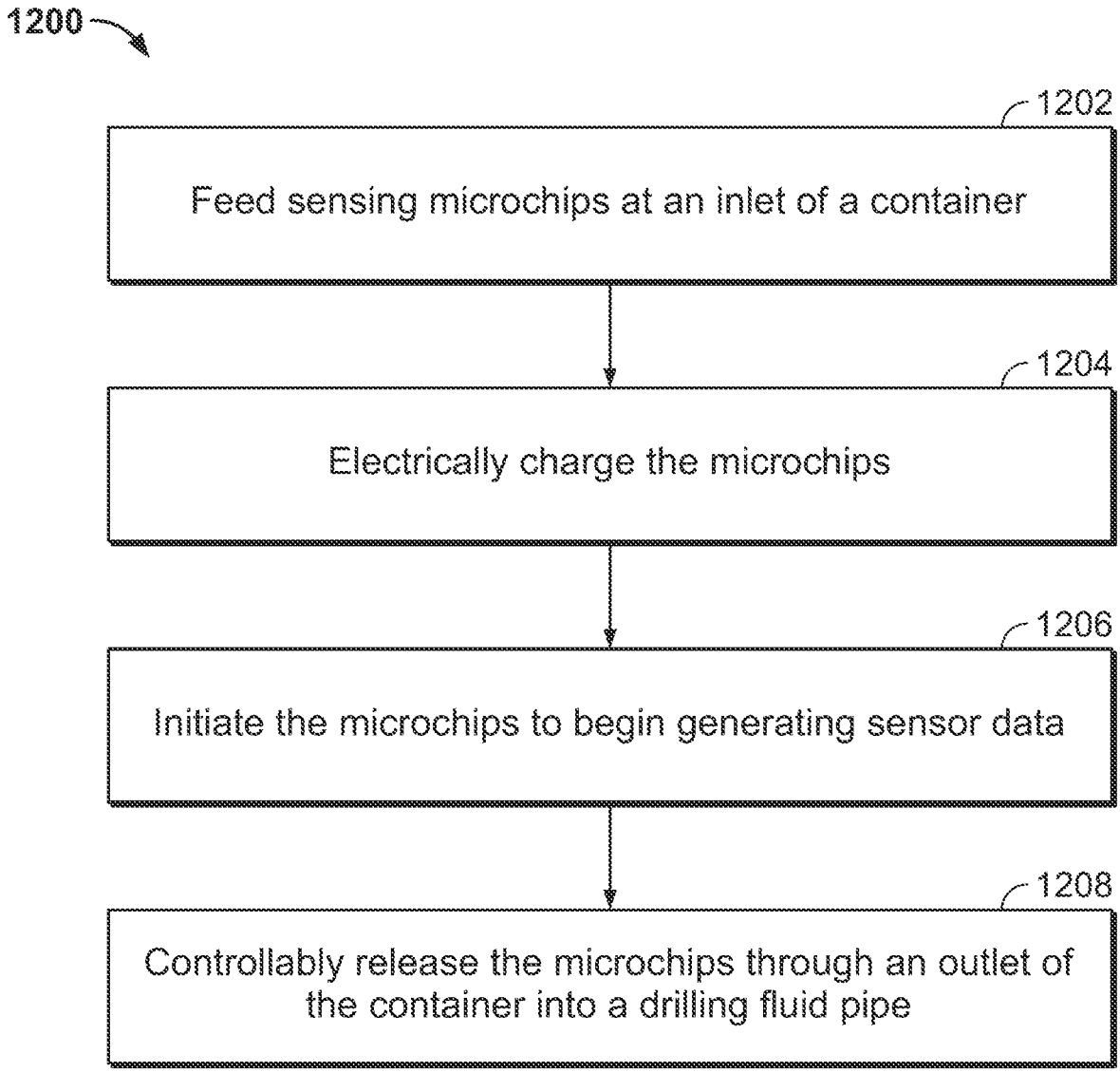
FIG. 12 illustrates a flow chart of an example process for dispensing microchips.

FIG. 12 illustrates a flow chart of an example process 1200 for dispensing microchips.

The process 1200 includes feeding sensing microchips at an inlet of a container (1202). For example, referring to FIG. 3, microchips 310 including sensors can be fed at an inlet 302 of a container 314. The microchips 310 can be fed into the container 214 manually or automatically. In some examples, the microchips 310 are fed into the container 214 from a larger vessel that stores the microchips.

The process 1200 includes electrically charging the microchips (1204). For example, referring to FIG. 3, the microchips 310 can be electrical charged by energizing the electrical coil 320. Electrically charging a microchip 310 includes charging a power source of the microchip 310.

The process 1200 includes initiating the microchips to begin generating sensor data (1206). For example, referring to FIG. 3, the microchips 310 can be initiated by energizing the electrical coil 320. Initiating a microchip 310 can include sending a signal to sensors of the microchip 310 that cause the sensors to begin generating and/or transmitting sensor data.

The process 1200 includes controllably releasing the microchips through an outlet of the container into a drilling fluid pipe (1208). For example, referring to FIG. 7, an actuator 726 can drive a release mechanism 718 to release one or more microchips (e.g., microchip 710*a*-7) through an outlet 704 of the container 714. The actuator 726 can be controlled by a controller 724. The release mechanism 718 can include, for example, springs, pistons, rams, valves, plates, apertures, selection devices, or any combination of these.

Figure 13:
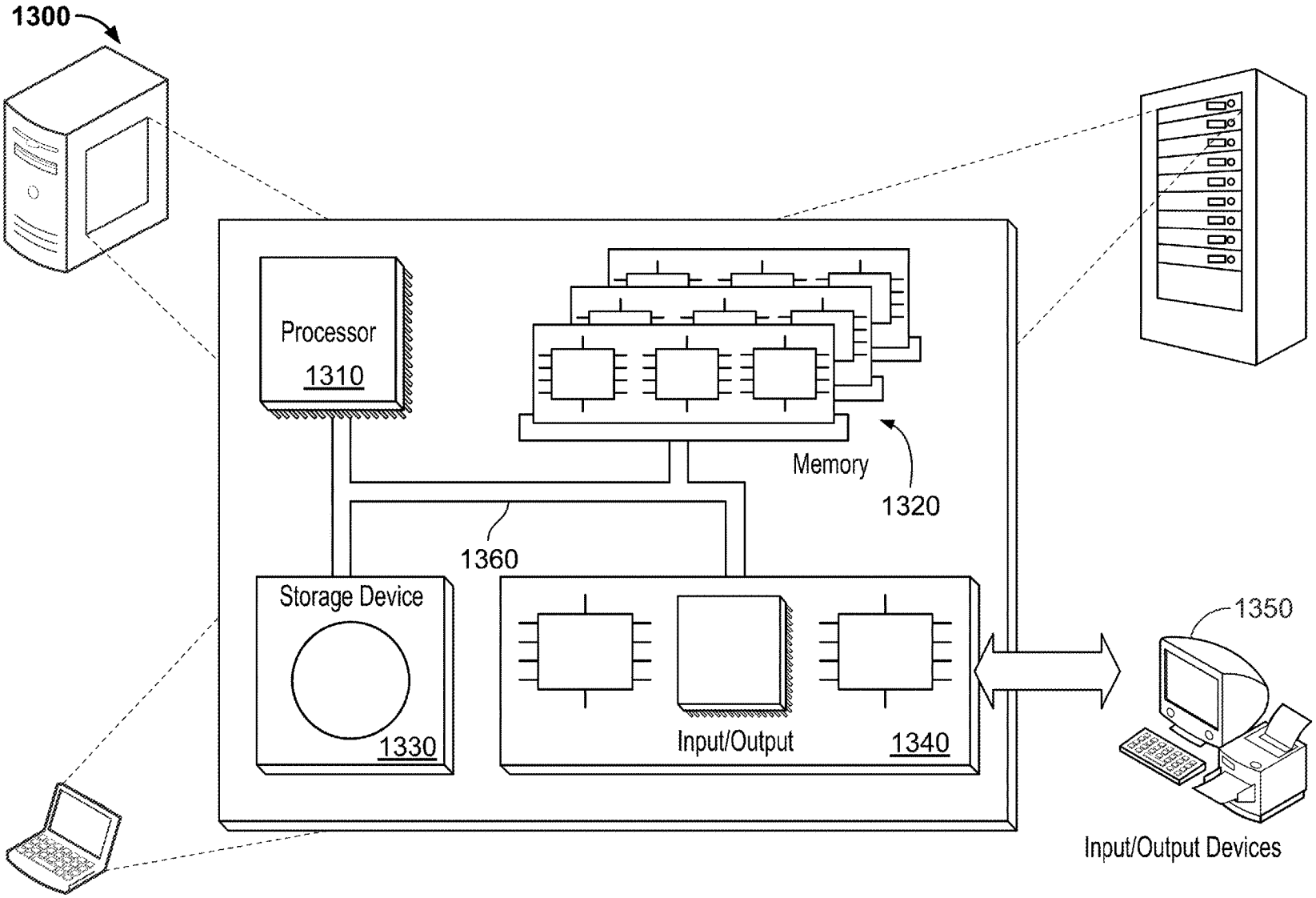
FIG. 13 depicts an example computing system, according to implementations of the present disclosure.

FIG. 13 depicts an example computing system, according to implementations of the present disclosure. The system 1300 may be used for any of the operations described with respect to the various implementations discussed herein. For example, the system 1300 may be included, at least in part, in the control system and/or other computing device(s) or system(s) described herein. The system 1300 may include one or more processors 1310, a memory 1320, one or more storage devices 1330, and one or more input/output (I/O) devices 1350 controllable via one or more I/O interfaces 1340. The various components 1310, 1320, 1330, 1340, or 1350 may be interconnected via at least one system bus 1360, which may enable the transfer of data between the various modules and components of the system 1300.

The processor(s) 1310 may be configured to process instructions for execution within the system 1300. The processor(s) 1310 may include single-threaded processor(s), multi-threaded processor(s), or both. The processor(s) 1310 may be configured to process instructions stored in the memory 1320 or on the storage device(s) 1330. For example, the processor(s) 1310 may execute instructions for the various software module(s) described herein. The processor(s) 1310 may include hardware-based processor(s) each including one or more cores. The processor(s) 1310 may include general purpose processor(s), special purpose processor(s), or both.

The memory 1320 may store information within the system 1300. In some implementations, the memory 1320 includes one or more computer-readable media. The memory 1320 may include any number of volatile memory units, any number of non-volatile memory units, or both volatile and non-volatile memory units. The memory 1320 may include read-only memory, random access memory, or both. In some examples, the memory 1320 may be employed as active or physical memory by one or more executing software modules.

The storage device(s) 1330 may be configured to provide (e.g., persistent) mass storage for the system 1300. In some implementations, the storage device(s) 1330 may include one or more computer-readable media. For example, the storage device(s) 1330 may include a floppy disk device, a hard disk device, an optical disk device, or a tape device. The storage device(s) 1330 may include read-only memory, random access memory, or both. The storage device(s) 1330 may include one or more of an internal hard drive, an external hard drive, or a removable drive.

One or both of the memory 1320 or the storage device(s) 1330 may include one or more computer-readable storage media (CRSM). The CRSM may include one or more of an electronic storage medium, a magnetic storage medium, an optical storage medium, a magneto-optical storage medium, a quantum storage medium, a mechanical computer storage medium, and so forth. The CRSM may provide storage of computer-readable instructions describing data structures, processes, applications, programs, other modules, or other data for the operation of the system 1300. In some implementations, the CRSM may include a data store that provides storage of computer-readable instructions or other information in a non-transitory format. The CRSM may be incorporated into the system 1300 or may be external with respect to the system 1300. The CRSM may include read-only memory, random access memory, or both. One or more CRSM suitable for tangibly embodying computer program instructions and data may include any type of non-volatile memory, including but not limited to: semiconductor memory devices, such as EPROM, EEPROM, and flash memory devices; magnetic disks such as internal hard disks and removable disks; magneto-optical disks; and CD-ROM and DVD-ROM disks. In some examples, the processor(s) 1310 and the memory 1320 may be supplemented by, or incorporated into, one or more application-specific integrated circuits (ASICs).

The system 1300 may include one or more I/O devices 1350. The I/O device(s) 1350 may include one or more input devices such as a keyboard, a mouse, a pen, a game controller, a touch input device, an audio input device (e.g., a microphone), a gestural input device, a haptic input device, an image or video capture device (e.g., a camera), or other devices. In some examples, the I/O device(s) 1350 may also include one or more output devices such as a display, LED(s), an audio output device (e.g., a speaker), a printer, a haptic output device, and so forth. The I/O device(s) 1350 may be physically incorporated in one or more computing devices of the system 1300, or may be external with respect to one or more computing devices of the system 1300.

The system 1300 may include one or more I/O interfaces 1340 to enable components or modules of the system 1300 to control, interface with, or otherwise communicate with the I/O device(s) 1350. The I/O interface(s) 1340 may enable information to be transferred in or out of the system 1300, or between components of the system 1300, through serial communication, parallel communication, or other types of communication. For example, the I/O interface(s) 1340 may comply with a version of the RS-232 standard for serial ports, or with a version of the IEEE 1284 standard for parallel ports. As another example, the I/O interface(s) 1340 may be configured to provide a connection over Universal Serial Bus (USB) or Ethernet. In some examples, the I/O interface(s) 1340 may be configured to provide a serial connection that is compliant with a version of the IEEE 1394 standard.

The I/O interface(s) 1340 may also include one or more network interfaces that enable communications between computing devices in the system 1300, or between the system 1300 and other network-connected computing systems. The network interface(s) may include one or more network interface controllers (NICs) or other types of transceiver devices configured to send and receive communications over one or more communication networks using any network protocol.

Computing devices of the system 1300 may communicate with one another, or with other computing devices, using one or more communication networks. Such communication networks may include public networks such as the internet, private networks such as an institutional or personal intranet, or any combination of private and public networks. The communication networks may include any type of wired or wireless network, including but not limited to local area networks (LANs), wide area networks (WANs), wireless WANs (WWANs), wireless LANs (WLANs), mobile communications networks (e.g., 3G, 4G, Edge, etc.), and so forth. In some implementations, the communications between computing devices may be encrypted or otherwise secured. For example, communications may employ one or more public or private cryptographic keys, ciphers, digital certificates, or other credentials supported by a security protocol, such as any version of the Secure Sockets Layer (SSL) or the Transport Layer Security (TLS) protocol.

The system 1300 may include any number of computing devices of any type. The computing device(s) may include, but are not limited to: a personal computer, a smartphone, a tablet computer, a wearable computer, an implanted computer, a mobile gaming device, an electronic book reader, an automotive computer, a desktop computer, a laptop computer, a notebook computer, a game console, a home entertainment device, a network computer, a server computer, a mainframe computer, a distributed computing device (e.g., a cloud computing device), a microcomputer, a system on a chip (SoC), a system in a package (SiP), and so forth. Although examples herein may describe computing device (s) as physical device(s), implementations are not so limited. In some examples, a computing device may include one or more of a virtual computing environment, a hypervisor, an emulation, or a virtual machine executing on one or more physical computing devices. In some examples, two or more computing devices may include a cluster, cloud, farm, or other grouping of multiple devices that coordinate operations to provide load balancing, failover support, parallel processing capabilities, shared storage resources, shared networking capabilities, or other aspects.

It is understood that the articles "a," "an," and "the" in this disclosure are intended to mean that there are one or more of the elements in the preceding descriptions. The terms "comprising," "including," and "having" are intended to be inclusive and mean that there may be additional elements other than the listed elements. Additionally, it should be understood that references to "one example" or "an example" of the present disclosure are not intended to be interpreted as excluding the existence of additional examples that also incorporate the recited features. For example, any element described in relation to an example herein may be combinable with any element of any other example described herein. Numbers, percentages, ratios, or other values stated herein are intended to include that value, and also other values that are "about" or "approximately" the stated value, as would be appreciated by one of ordinary skill in the art encompassed by examples of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

While this specification contains many specifics, these should not be construed as limitations on the scope of the disclosure or of what may be claimed, but rather as descriptions of features specific to particular implementations. Certain features that are described in this specification in the context of separate implementations may also be implemented in combination in a single implementation. Conversely, various features that are described in the context of a single implementation may also be implemented in multiple implementations separately or in any suitable sub-combination. Moreover, although features may be described above as acting in certain combinations and even initially claimed as such, one or more features from a claimed combination may in some examples be excised from the combination, and the claimed combination may be directed to a sub-combination or variation of a sub-combination.

A number of implementations have been described. Nevertheless, it will be understood that various modifications may be made without departing from the spirit and scope of the disclosure. Accordingly, other implementations are within the scope of the following claim(s). For example, various forms of the flows shown above may be used, with steps re-ordered, added, or removed. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous. Moreover, aspects described with reference to any figure or any implementation can be combined with aspects described with any other figure or any other implementation.

What is claimed is:

1. A drilling fluid system, comprising:

at least one microprocessor device;

a container that defines an interior volume;

a container inlet that provides access for entry of the at least one microprocessor device into the interior volume of the container;

a container outlet that provides egress for passage of the at least one microprocessor device from the interior volume of the container into a drilling fluid conduit of the drilling system, the drilling fluid conduit comprising a drilling fluid pipe, and the at least one microprocessor device passes through the container outlet to a portion of the drilling fluid conduit that is positioned at or above a terranean surface, the container outlet having a higher elevation than the portion of the drilling fluid conduit, and movement of the at least one microprocessor device through the container outlet to the drilling fluid conduit is assisted by gravity; and a dispenser apparatus configured to controllably release the at least one microprocessor device through the container outlet into the drilling fluid conduit of the drilling system.

2. The drilling fluid system of claim 1, wherein the at least one microprocessor device comprises a power source and one or more sensors configured to generate sensor data indicating downhole conditions of a well.

3. The drilling fluid system of claim 2, wherein the at least one microprocessor device is configured to wirelessly transmit the sensor data to a computer at a terranean surface.

4. The drilling fluid system of claim 2, comprising:

an initiation circuit configured to initiate the microprocessor device when the microprocessor device is within the interior volume of the container, wherein initiation of the at least one microprocessor device causes the one or more sensors to begin generating the sensor data.

5. The drilling fluid system of claim 2, comprising:

a charging circuit configured to electrically charge the power source when the at least one microprocessor device is within the interior volume of the container.

6. The drilling fluid system of claim 1, wherein the container inlet has a higher elevation than the container outlet, and movement of the at least one microprocessor device through the interior volume from the container inlet to the container outlet is assisted by gravity.

7. The drilling fluid system of claim 1, comprising a loading device configured to exert a force on the at least one microprocessor device at the container inlet, and movement of the at least one microprocessor device through the interior volume from the container inlet to the container outlet is assisted by the exerted force.

8. The drilling fluid system of claim 1, wherein the dispenser apparatus comprises a piston operable to exert a force on a microprocessor device of the at least one microprocessor device at the container outlet, and movement of the at least one microprocessor device through the container outlet is assisted by the exerted force.

9. The drilling fluid system of claim 1, wherein the dispenser apparatus comprises:

a valve comprising a plate defining an aperture;

a motor coupled to the valve and operable to move the valve relative to the container outlet to align the plate or the aperture with the container outlet, wherein:

the plate aligning with the container outlet prevents egress of the at least one microprocessor device from the interior volume; and the aperture aligning with the container outlet permits egress of the at least one microprocessor device from the interior volume through the container outlet.

10. The drilling fluid system of claim 1, comprising:

a control system communicably coupled to the dispenser apparatus, the control system configured to operate the dispenser apparatus to automatically insert the at least one microprocessor device into the drilling fluid conduit at a controlled rate of insertion.

11. The drilling fluid system of claim 1, wherein the at least one microprocessor device comprises a microchip comprising:

a casing enclosing an interior region of the microchip, wherein the casing has a substantially spherical exterior shape, a diameter of the casing being fifteen millimeters or less; and a printed circuit board disposed within the interior region of the microchip.

12. A method, comprising:

feeding at least one microprocessor device at a container inlet of a container that defines an interior volume, wherein the container inlet provides access for entry of the at least one microprocessor device into the interior volume of the container; and controllably releasing the at least one microprocessor device through a container outlet, wherein the container outlet provides egress for passage of the at least one microprocessor device from the interior volume of the container into a drilling fluid conduit of a drilling system, wherein:

the drilling fluid conduit is a pipe;

the at least one microprocessor device passes through the container outlet to a portion of the pipe that is positioned at or above a terranean surface;

a pressure of the interior volume is lower than a pressure of the portion of the drilling fluid conduit; and controllably releasing the at least one microprocessor device through the container outlet comprises exerting a force from a piston onto a microprocessor device to move the microprocessor device through the container outlet from the lower pressure of the interior volume to the higher pressure of the portion of the drilling fluid conduit.

13. The method of claim 12, wherein the at least one microprocessor device comprises a power source and one or more sensors and is configured to generate sensor data indicating downhole conditions of the drilling system.

14. The method of claim 13, comprising:

initiating the at least one microprocessor device with an initiation circuit when the at least one microprocessor device is within the interior volume of the container, wherein initiation of the at least one microprocessor device causes the at least one microprocessor device to begin generating the sensor data; and electrically charging the power source with a charging circuit when the at least one microprocessor device is within the interior volume of the container.

15. The method of claim 12, comprising exerting, by a loading device, a force on the at least one microprocessor devices at the container inlet to cause the at least one microprocessor device to pass through the interior volume from the container inlet to the container outlet.

16. The method of claim 12, wherein controllably releasing the at least one microprocessor device through the container outlet comprises moving a valve comprising a plate and an aperture relative to the container outlet, including:

moving the valve to align the plate with the container outlet to prevent microprocessor device egress from the interior volume; and moving the valve to align the aperture with the container outlet to permit microprocessor device egress from the interior volume through the container outlet.

17. The method of claim 16, wherein controllably releasing the at least one microprocessor device through the container outlet comprises controlling a rate of inserting the at least one microprocessor devices into the drilling fluid conduit.

18. A drilling fluid system, comprising:

at least one microprocessor device;

a container that defines an interior volume;

a container inlet that provides access for entry of the at least one microprocessor device into the interior volume of the container;

a container outlet that provides egress for passage of the at least one microprocessor device from the interior volume of the container into a drilling fluid conduit of the drilling system; and a dispenser apparatus configured to controllably release the at least one microprocessor device through the container outlet into the drilling fluid conduit of the drilling system, the dispenser apparatus comprising a piston operable to exert a force on a microprocessor device of the at least one microprocessor device at the container outlet, and movement of the at least one microprocessor device through the container outlet is assisted by the exerted force.

19. The drilling fluid system of claim 18, wherein the at least one microprocessor device comprises a power source and one or more sensors configured to generate sensor data indicating downhole conditions of a well.

20. The drilling fluid system of claim 19, wherein the at least one microprocessor device is configured to wirelessly transmit the sensor data to a computer at a terranean surface.

21. The drilling fluid system of claim 19, comprising:

an initiation circuit configured to initiate the microprocessor device when the microprocessor device is within the interior volume of the container, wherein initiation of the at least one microprocessor device causes the one or more sensors to begin generating the sensor data.

22. The drilling fluid system of claim 19, comprising:

a charging circuit configured to electrically charge the power source when the at least one microprocessor device is within the interior volume of the container.

23. The drilling fluid system of claim 18, wherein the container inlet has a higher elevation than the container outlet, and movement of the at least one microprocessor device through the interior volume from the container inlet to the container outlet is assisted by gravity.

24. The drilling fluid system of claim 18, comprising a loading device configured to exert a force on the at least one microprocessor device at the container inlet, and movement of the at least one microprocessor device through the interior volume from the container inlet to the container outlet is assisted by the exerted force.

25. The drilling fluid system of claim 18, wherein the dispenser apparatus comprises:

a valve comprising a plate defining an aperture;

a motor coupled to the valve and operable to move the valve relative to the container outlet to align the plate or the aperture with the container outlet, wherein:

the plate aligning with the container outlet prevents egress of the at least one microprocessor device from the interior volume; and the aperture aligning with the container outlet permits egress of the at least one microprocessor device from the interior volume through the container outlet.

26. The drilling fluid system of claim 18, comprising:

a control system communicably coupled to the dispenser apparatus, the control system configured to operate the dispenser apparatus to automatically insert the at least one microprocessor device into the drilling fluid conduit at a controlled rate of insertion.

27. The drilling fluid system of claim 18, wherein the at least one microprocessor device comprises a microchip comprising:

a casing enclosing an interior region of the microchip, wherein the casing has a substantially spherical exterior shape, a diameter of the casing being fifteen millimeters or less; and a printed circuit board disposed within the interior region of the microchip.

28. A drilling fluid system, comprising:

at least one microprocessor device;

a container that defines an interior volume;

a container inlet that provides access for entry of the at least one microprocessor device into the interior volume of the container;

a container outlet that provides egress for passage of the at least one microprocessor device from the interior volume of the container into a drilling fluid conduit of the drilling system; and a dispenser apparatus configured to controllably release the at least one microprocessor device through the container outlet into the drilling fluid conduit of the drilling system, the dispenser apparatus comprising:

a valve comprising a plate defining an aperture;

a motor coupled to the valve and operable to move the valve relative to the container outlet to align the plate or the aperture with the container outlet, wherein:

the plate aligning with the container outlet prevents egress of the at least one microprocessor device from the interior volume; and the aperture aligning with the container outlet permits egress of the at least one microprocessor device from the interior volume through the container outlet.

29. The drilling fluid system of claim 28, wherein the at least one microprocessor device comprises a power source and one or more sensors configured to generate sensor data indicating downhole conditions of a well.

30. The drilling fluid system of claim 29, wherein the at least one microprocessor device is configured to wirelessly transmit the sensor data to a computer at a terranean surface.

31. The drilling fluid system of claim 29, comprising:

an initiation circuit configured to initiate the microprocessor device when the microprocessor device is within the interior volume of the container, wherein initiation of the at least one microprocessor device causes the one or more sensors to begin generating the sensor data.

32. The drilling fluid system of claim 29, comprising:

a charging circuit configured to electrically charge the power source when the at least one microprocessor device is within the interior volume of the container.

33. The drilling fluid system of claim 28, wherein the container inlet has a higher elevation than the container outlet, and movement of the at least one microprocessor device through the interior volume from the container inlet to the container outlet is assisted by gravity.

34. The drilling fluid system of claim 28, comprising a loading device configured to exert a force on the at least one microprocessor device at the container inlet, and movement of the at least one microprocessor device through the interior volume from the container inlet to the container outlet is assisted by the exerted force.

35. The drilling fluid system of claim 28, wherein the dispenser apparatus comprises a piston operable to exert a force on a microprocessor device of the at least one microprocessor device at the container outlet, and movement of the at least one microprocessor device through the container outlet is assisted by the exerted force.

36. The drilling fluid system of claim 28, comprising:

a control system communicably coupled to the dispenser apparatus, the control system configured to operate the dispenser apparatus to automatically insert the at least one microprocessor device into the drilling fluid conduit at a controlled rate of insertion.

37. The drilling fluid system of claim 28, wherein the at least one microprocessor device comprises a microchip comprising:

a casing enclosing an interior region of the microchip, wherein the casing has a substantially spherical exterior shape, a diameter of the casing being fifteen millimeters or less; and a printed circuit board disposed within the interior region of the microchip.

38. A drilling fluid system, comprising:

at least one microprocessor device comprising a microchip that includes:

a casing enclosing an interior region of the microchip, wherein the casing has a substantially spherical exterior shape, a diameter of the casing being fifteen millimeters or less; and a printed circuit board disposed within the interior region of the microchip;

a container that defines an interior volume;

a container inlet that provides access for entry of the at least one microprocessor device into the interior volume of the container;

a container outlet that provides egress for passage of the at least one microprocessor device from the interior volume of the container into a drilling fluid conduit of the drilling system; and a dispenser apparatus configured to controllably release the at least one microprocessor device through the container outlet into the drilling fluid conduit of the drilling system.

39. The drilling fluid system of claim 38, wherein the at least one microprocessor device comprises a power source and one or more sensors configured to generate sensor data indicating downhole conditions of a well.

40. The drilling fluid system of claim 39, wherein the at least one microprocessor device is configured to wirelessly transmit the sensor data to a computer at a terranean surface.

41. The drilling fluid system of claim 39, comprising:

an initiation circuit configured to initiate the microprocessor device when the microprocessor device is within the interior volume of the container, wherein initiation of the at least one microprocessor device causes the one or more sensors to begin generating the sensor data.

42. The drilling fluid system of claim 39, comprising:

a charging circuit configured to electrically charge the power source when the at least one microprocessor device is within the interior volume of the container.

43. The drilling fluid system of claim 38, wherein the container inlet has a higher elevation than the container outlet, and movement of the at least one microprocessor device through the interior volume from the container inlet to the container outlet is assisted by gravity.

44. The drilling fluid system of claim 38, comprising a loading device configured to exert a force on the at least one microprocessor device at the container inlet, and movement of the at least one microprocessor device through the interior volume from the container inlet to the container outlet is assisted by the exerted force.

45. The drilling fluid system of claim 38, wherein the dispenser apparatus comprises a piston operable to exert a force on a microprocessor device of the at least one microprocessor device at the container outlet, and movement of the at least one microprocessor device through the container outlet is assisted by the exerted force.

46. The drilling fluid system of claim 38, wherein the dispenser apparatus comprises:

a valve comprising a plate defining an aperture;

a motor coupled to the valve and operable to move the valve relative to the container outlet to align the plate or the aperture with the container outlet, wherein:

the plate aligning with the container outlet prevents egress of the at least one microprocessor device from the interior volume; and the aperture aligning with the container outlet permits egress of the at least one microprocessor device from the interior volume through the container outlet.

47. The drilling fluid system of claim 38, comprising:

a control system communicably coupled to the dispenser apparatus, the control system configured to operate the dispenser apparatus to automatically insert the at least one microprocessor device into the drilling fluid conduit at a controlled rate of insertion.

48. A method, comprising:

feeding at least one microprocessor device at a container inlet of a container that defines an interior volume, wherein the container inlet provides access for entry of the at least one microprocessor device into the interior volume of the container; and controllably releasing the at least one microprocessor device through a container outlet, wherein the container outlet provides egress for passage of the at least one microprocessor device from the interior volume of the container into a drilling fluid conduit of a drilling system, wherein controllably releasing the at least one microprocessor device through the container outlet comprises moving a valve comprising a plate and an aperture relative to the container outlet, including:

moving the valve to align the plate with the container outlet to prevent microprocessor device egress from the interior volume; and moving the valve to align the aperture with the container outlet to permit microprocessor device egress from the interior volume through the container outlet.

49. The method of claim 48, wherein the at least one microprocessor device comprises a power source and one or more sensors and is configured to generate sensor data indicating downhole conditions of the drilling system.

50. The method of claim 49, comprising:

initiating the at least one microprocessor device with an initiation circuit when the at least one microprocessor device is within the interior volume of the container, wherein initiation of the at least one microprocessor device causes the at least one microprocessor device to begin generating the sensor data; and electrically charging the power source with a charging circuit when the at least one microprocessor device is within the interior volume of the container.

51. The method of claim 48, comprising exerting, by a loading device, a force on the at least one microprocessor devices at the container inlet to cause the at least one microprocessor device to pass through the interior volume from the container inlet to the container outlet.

52. The method of claim 48, wherein controllably releasing the at least one microprocessor device through the container outlet comprises controlling a rate of inserting the at least one microprocessor devices into the drilling fluid conduit.

* * * * *